United States Patent [19]

Shima

[11] Patent Number: 4,637,228

[45] Date of Patent: Jan. 20, 1987

[54] FLAT KNITTING MACHINE HAVING COMPOUND NEEDLES

[75] Inventor: Masahiro Shima, Wakayama, Japan

[73] Assignee: Shima Idea Center Co., Ltd., Wakayama, Japan

[21] Appl. No.: 879,328

[22] Filed: Jun. 27, 1986

[30] Foreign Application Priority Data

Jul. 18, 1985 [JP] Japan ..... 60-159662

[51] Int. Cl.[4] ..... D04B 7/00

[52] U.S. Cl. ..... 66/75.1; 66/120; 66/78

[58] Field of Search ..... 66/78, 75.1, 75.2, 120, 66/70

[56] References Cited

U.S. PATENT DOCUMENTS

| | | | |
|---|---|---|---|
| 4,109,490 | 8/1978 | Bosch | 66/120 |
| 4,448,044 | 5/1984 | Kühnert | 66/120 |
| 4,448,045 | 5/1984 | Kühnert | 66/120 |
| 4,474,037 | 10/1984 | Kühnert | 66/70 |

*Primary Examiner*—Ronald Feldbaum

*Attorney, Agent, or Firm*—Tilton, Fallon, Lungmus & Chestnut

[57] ABSTRACT

A plurality of compound needles 1 are arranged in corresponding needle tricks 20, their butts 11, 14 being selectively caused to sink into the needle tricks during the movement of a carriage. A stitch receiving course raising cam 41 which acts on the butts 14 of individual needle bodies at welt position (WC) is disposed on a cam plate 31 of the carriage and in a space defined between a pair of cam faces 32*a* of a tuck position raising cam 32 which act on the butts 14 of individual needle bodies. Above the cam 41 there are provided stitch receiving courses (REC) for the butts 14 which lead to a tucking course (TC) through the space 40, and a stitch transfer position raising cam 37 which acts on the butt 14 of each needle body raised to a tuck position or knit position. On the cam plate 31 there are also provided slider guide cams 42 for acting on the butts 11 of sliders 5 to lower the sliders to the tuck course (TC), and sliders raising cam 36 for acting on the butts 11 of sliders 5 raised to the tuck course (TC) to raise the sliders to a level suitable for their passage above the slider guide cams 42. The compound needles 1 in the flat knitting machine may be selectively caused to knit, tuck, welt, or perform stitch transfer.

16 Claims, 23 Drawing Figures

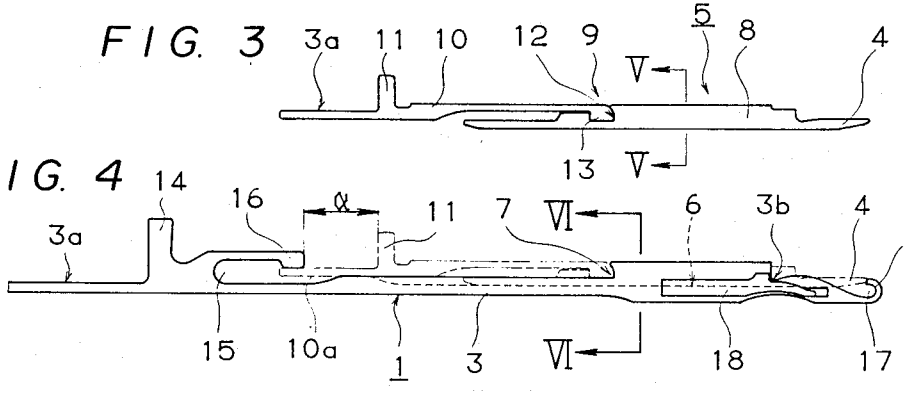
FIG. 3
FIG. 4
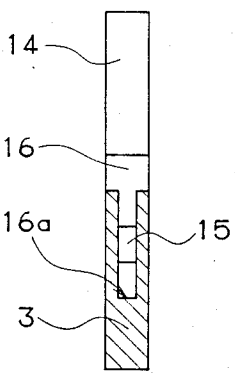
FIG. 6
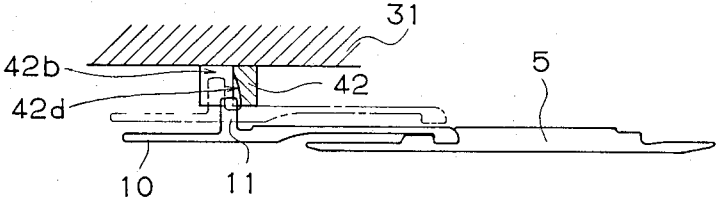
FIG. 9
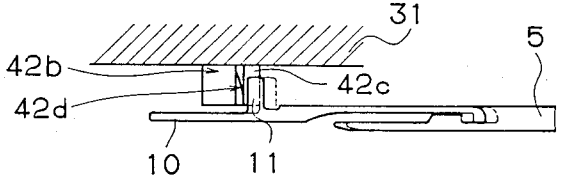
FIG. 10
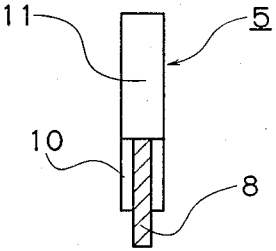
FIG. 5
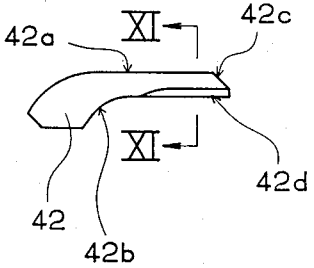
FIG. 8

FLAT KNITTING MACHINE HAVING COMPOUND NEEDLES

BACKGROUND OF THE INVENTION

(Industrial Field of Application)

The present invention relates to a flat knitting machine having compound needles each consisting essentially of a combination of a needle body having a hook portion and a slider for closing and opening a mouth of the hook portion.

(Prior Art)

A compound needle is well known which is of the type such that a slider combined slidably with a needle body is back and forth movable over a given limited stroke relative to the needle body so that a hook portion of the needle body is closed and opened by means of a latch portion of a slider as the slider is thrusted from and retracted into the needle body.

However, none of the prior-art flat knitting machines having compound needles of such type incorporated therein are such that any needles selected in same course can be selectively caused to knit, tuck, welt, or transfer.

SUMMARY OF THE INVENTION

(Problems Sought to be Solved by the Invention)

It is an object of the present invention to provide a flat knitting machine having compound needles wherein any needles selected in same course may be selectively caused to knit, tuck, welt, or transfer.

It is another object of the invention to permit individual needles to perform the desired stable knitting operation when any selected needles are caused to knit in any course while any other selected needles are caused to tuck or perform transfer in same course.

Primarily, a compound needle has an advantage that the hook portion of the needle body can be closed and opened with a smaller stroke of the slider as compared with a stroke required in swinging the latch of a latch needle. The compound needle has a further advantage that if there is any arrangement such that an old stitch which does not mount on the slider at the stage of tucking is allowed to mount on the slider at the stage of knitting by slightly pushing up the slider on the needle body raised to the tuck position or by slightly pushing up the needle body raised to the tuck position, the needle may be caused to knit or tuck. In the case where selected needles are caused to knit while other selected needles are caused to tuck to perform transfer, however, if the amount of movement of the slider or of the needle body is too small, both the hook portion of each needle body tucking or receiving a stitch and the hook portion of each adjacent needle body knitting may begin to close at little time intervals when the needle bodies, to the hooks of which yarn feed or stitch transfer has been made, begin to move downward; therefore, on the side of the needle body knitting, on one hand, it is difficult to allow the old stitch to be accurately held in position outside the hook portion, while on the side of the needle body tucking or receiving the stitch, on the other hand, it is difficult to guide the old stitch into the hook. In order to avoid such difficulty, the amount of movement of the slider from the tuck position to the knit position may be made greater, or an alternative may be that the difference between the push-up stroke of the needle body during knitting operation and the push-up stroke of the needle body during tucking or transfer operation is made greater. However, this would necessitate a corresponding increase in the size of the knitting lock. More particularly, if the upward stroke of the needle body to its stitch receiving position is to be increased on one hand, and yet if, on the other hand, transfer blades formed on the sides of the stitch-receiving needle body are to be prevented from striking transfer blades on the sides of the stitch-transferring needle body when the former needle body is raised to the stitch receiving position, it is absolutely necessary that the transfer blades be disposed so much away from the hook portion. However, if such arrangement is made at all, it would naturally necessitate a further corresponding increase in the amount of upward stroke of the needle body on the stitch transferring side and of longitudinal stroke of the slider on the needle body at the stage of stitch transfer. The present invention contemplates the provision of a flat knitting machine having compound needles which involves least increase in the amount of longitudinal stroke of the slider on the needle body or of upward stroke of the needle body to the knit position, stitch-receiving position, and/or stitch-transfer position, and in which if, in accordance with the invention, any selected compound needles are caused to knit and any other selected compound needles are caused to tuck or perform transfer in same course, on the part of each needle which knits, an old stitch which has been carried by the needle may be accurately held in a stable ready-to-knit position outside the hook or on the slider outside the hook so that it may be accurately knocked over with a newly formed stitch, while on the part of each needle tucking or receiving a stitch through transfer, on the other hand, an old stitch which has been carried thereby may be held in a stable ready-to-tuck position in the hook or leading to the hook so that a newly formed stitch or a transferred stitch may be accurately placed thereover.

(Means for Solving the Problems)

The present invention will now be described with reference to the accompanying drawings which illustrate the embodiments thereof. According to its first aspect, the invention provides a flat knitting machine having compound needles 1 of the type having a slider 5 combined slidably with a needle body 3 wherein the slider 5 is back and forth movable over a given limited stroke $\alpha$ relative to the needle body 3 so that a latch portion 4 of the slider 5 is brought to a closed position and an open position with respect to a hook portion 17 of the needle body 3, characterized in:

(1) that the needle body 3 is so fixedly constructed as to allow a butt 14 of the needle body 3 to sink into a corresponding needle trick 20 when the upper surface of the needle body 3 is pressed at a point behind the butt 14;

(2) that both the slider 5 and the needle body 3 have one butt 11,14 each provided thereon, the butt 11 of the slider being located before the butt 14 of the needle body;

(3) that a selector jack 22 for pressing at the underside of its front portion the upper surface of the needle body 3 at a point behind the butt 14 thereof is disposed in the needle trick 20, above the needle body 3 and behind the butt 14 thereof, the front portion of the selector jack 22 being pivotally movable and having an upwardly projecting butt 26 provided thereon;

(4) that said selector jack 22 is back and forth movable in the needle trick 20 and adapted to be click stopped adjacent its rear end by means of a click stopper 23 at three positions, advanced position (I), intermediate position (II), and retreated position (III), in the needle trick 20 in the longitudinal direction thereof, being pivotally movable about the click stopper 23;

(5) that needle selector means for selectively moving any selector jack or jacks 22 to any one of said three positions are arranged in individual needle tricks 20, at a level above the selector jacks 22 therein, and on a carriage.

(6) that a knitting lock on the carriage includes a tuck position raising cam 32 having a pair of raising cam faces 32*a* for acting on the butt 14 of each relevant needle body to raise the needle body 3 to a tuck position (TL), a pair of slider guide cams 42 each having a lowering cam 42*b* for acting on the butt 11 of slider of each compound needle 1 whose needle body has been raised to the tuck position (TL) or into a stitch receiving course (REC), to lower the slider 5 into a tucking course, a slider raising cam 36 having a pair of raising cam faces 36*a* for acting on the butt 11 of slider of each compound needle 1 whose needle body 3 has been raised to the tuck position (TL), at a position ahead of said slider guide cam 42 in the direction of movement of the carriage to raise the butt 11 to a position that allows it to pass above said slider guide cam 42, a center guide cam 35 for acting on the butt 14 of the needle body to lower the needle body 3, and a pair of stitch cams 34;

(7) that a space 40 which allows the entry thereinto of the butt 14 of each needle body, when on a welt course, is formed between the respective back sides of said pair of raising cam faces 32*a* of the tuck position raising cam 32, there being disposed in the middle of said space 40 a stitch-receiving-course raising cam 41 having a pair of raising cam faces 41*a* each for acting on the butt 14 of the needle body at welt position (WL) to raise it into the stitch receiving course (REC), with a pair of stitch receiving courses (REC) formed above said stitch-receiving-course raising cam 41, said stitch receiving courses (REC) extending from the spaces 40 on both sides of the stitch-receiving course raising cam 41 into the tuck receiving course (TC);

(8) that on a cam plate 31 there is provided a stitch transfer position raising cam 37 having a pair of raising cam faces 37*a* for acting on the butt 14 of each needle body raised to tuck position (TL) of knit position (KL) to raise the needle body 3 to stitch transfer position (TRL);

(9) that said stitch transfer position raising cam 37 has a half height (H) in projection above the cam plate 31 or is rectractable;

(10) that on the cam plate 31 and in relevant courses of action relative to the butts 26 of individual selector jacks 22 at advanced position (I), intermediate position (II), and retreated position (III) respectively, there are provided, at a phase covering the starting end of each raising cam face of said tuck position raising cam 32 in the direction of carriage movement, said presser cams $45_1$,$45_2$ for selectively forcing the butts 14 of needle bodies into the corresponding needle tricks 20 and to their inoperative position relative to said tuck position raising cam 32; and at phases covering the respective raising cam faces of said stitch transfer position raising, slider raising, and stitch-receiving-course raising cams 36,37,41 in the direction of the carriage movement, center presser cams $46_1$,$47_3$ for selectively forcing the butts 14 of needle bodeies into the corresponding needle tricks 20 and to their inoperative positions relative to these raising cams.

(11) that one of said center presser cams $46_1$ may select a half-pressing position (h) at which the butt 14 of each needle body is half depressed into the corresponding needle trick 20; and

(12) that the butt 11 of said slider is displaceable between its inoperative position and its operative position relative to the slider raising cam 36 according to the difference in the amount of depression by said one center presser cam 46 between a full pressing position (f) and a half pressing position (h) or between a half pressing position (h) and a retracted position (O).

According to its second aspect, the invention provides a flat knitting machine having compound needles as above set forth, further characterized in:

(1) that on said cam plate 31 there are provided a knit position raising cam 33 having a pair of raising cam faces 33*a* for acting on the butt 14 of each needle body raised by the tuck position raising cam 32 to the tuck position (TL) to raise it to the knit position (KL); and (2) that said center presser cams 46 cover, in addition to said raising cam faces 36*a*, 37*a* and 41*a*, the raising cam faces 33*a* of said knit position raising cam 33 in the directions of carriage movement.

(Functions)

(First Aspect of the Invention) On a cam plate 31 of the flat knitting machine having compound needles according to the invention there are provided a tuck position raising cam 32, a stitch transfer position raising cam 37, slider raising cam 36, and a stitch receiving course raising cam 41, with their respective raising cam faces 32*a*, 37*a*, 36*a*, and 41*a* as aforesaid. The stitch receiving course raising cam 41 is disposed between the raising cam faces 32*a* in pair of the tuck position raising cam 32 and in a space 40 for entry of a butt 14 of each needle body while in a welt course (WC). Above the stitch receiving course raising cam 41 there are formed a pair of stitch receiving courses (REC) extending from the space 40 into a tucking course (TC). When any of these raising cams acts on the butt 14 of each needle body and on the butt 11 of each slider, the needle body 3 and/or the slider 5 is pushed upward accordingly. Each compound needle 1 is so flexibly constructed that when the needle body 3 is pressed on its upper surface 3*a* at a point behind the butt 14 of the needle body, the butt 14 of the needle body may be caused to sink into a corresponding needle trick 20. In each needle trick 20, a selector jack 22 is back and forth movably disposed which is able to cause the butt 14 of the needle body to sink into the needle trick 20 when the jack, at the underside 22*a* of its front portion, presses the upper surface 3*a* of the needle body at a point behind the butt 14. The selector jack 22 is provided with a needle selector device for selectively moving the jack over a range of three positions, advanced position (I), intermediate position (II), and retreated position (III), within the needle trick and in the longitudinal direction thereof. By such selector device is it possible to selectively position any selector jack 22 at one of the three positions, advanced position (I) or intermediate position (II) or retreated position (III). On the cam plate 31 there are provided side presser cam 45 and center presser cams 46, relative to each of the three positions (I), (II), (III), for acting on the respective butts 26 of selector jacks 22 selected to the three positions to selectively force the butts 14 of needle bodies into the corresponding needle tricks 20 which are outside the working range of the knitting lock. The side presser cams 45 each covers the beginning zone of a corresponding raising cam face 32*a* of the tuck position raising cam 32, which raises a needle body 3 to the tuck position, in the direction of carriage movement. The center presser cams 46, each covers corresponding raising cam faces 37*a*, 36*a*, and 41*a* respectively of the stitch transfer position raising cam 37, slider raising cam 36, and stitch receiving course raising cam 41 in the direction of carriage movement. When these presser cams 45, 46 are caused to act on the butt 26 on any selector jack 22 during carriage movement, the associated needle body 3 is bent so that the butt 14 thereof and the butt 11 of the slider 5 may be caused to sink into the corresponding needle trick 20 and to a position outside the respective working zones of the tuck position raising cam 32, stitch transfer position raising cam 37, stitch receiving course raising cam 41, and slider raising cam 36. One of the center presser cams 46 may select a half-pressing position (h) at which the butt 14 of each needle body is half depressed into the corresponding needle trick 20, so that the butt 11 of the slider may be displaced between inoperative and operative positions relative to the slider raising cam 36 according to the difference in the amount of depression by the center presser cam 46 between a full pressing position (f) and the half pressing position (h) or between the half pressing position (h) and a retracted position (O). In the flat knitting machine having compound needles in accordance with the invention, therefore, if the height of the butt 11 of the slider is set at a half height (H) or a full height (F), and if the height of slider raising cam 36 in projection above the cam plate 31 is set at full height (F) or half height (H), or set variable between full height (F) and half height (H) according to the height of the butt 11, with the stitch transfer position raising cam 37 set at half height in projection above the cam plate 31 or set to be retractable, any compound needles 1 may be selectively caused to knit, tuck, or transfer or receive stitches, or may be retained at welt position.

For example, if the height of the slider butt 1 is set at half height (H) at which if the butt 14 of the needle body is half depressed into the needle trick 20 the slider butt 11 is caused to sink fully into the needle trick 20, the height of slider raising cam 36 in projection above the cam plate 31 may be set at full height (F), or the same height as that of the tuck position raising cam 32 in projection above the cam plate 31. If the height of the slider butt 11 is set at full height (F) at which the slider butt 11 does not fully sink into the needle trick 20 unless the butt 14 of the needle body is fully depressed into the needle trick 20, the height of the slider raising cam 36 in preojection above the cam plate may be set at half height (H) or one half of the full height (F). In either case, the stitch transfer position raising cam 37 may be made retractable into the cam plate 31; for example, it may be of such construction that its height is variable between half height (H), at which the butt 14 of the needle body is inoperative if half depressed into the needle trick 20, and retracted position (O) at which the raising cam 37 is fully withdrawn into the cam plate 31. In all these case, any selected needles 1 may be controlled as follows (FIGS. 11 and 12):

(1) With the stitch transfer position raising cam 37 kept at its retracted positon (O), the side presser cams 45 are controlled to the retracted position (O) thereof and only the center presser cams 46 controlled to their respective half positions (h) are caused to act upon the butts 26 of selector jacks 22 at any of aforesaid three positions (I), (II), and (III), whereupon each of the compound needles 1 in the corresponding needle tricks 20 is raised to the tuck position (TL) by the tuck position raising cam 32 which acts on the butt 14 of the needle body. As the needle body 3 begins to go downward from the tuck position (TL) through the action of a lowering cam face 35*a* of a center guide cam 35 and of a lowering cam face 34*a* of a stitch cam 34, a lowring cam face 42*b* of the slider guide cam 42 is caused to act upon the slider butt 11 of the needle, whereby tucking may be performed.

(2) With the stitch transfer position raising cam 37 kept at its retracted position (O), both the side presser cams 45 and the center presser cams 46 are controlled to their retracted positions (O) so that they may be prevented from acting upon the butts 26 of selector jacks 22 at any selected one of the three positions (I), (II), and (III). Each of the compound needles 1 in the corresponding needle tricks 20 is accordingly raised to the tuck position (TL) by the tuck position raising cam 32 which acts on the butt 14 of the needle body, and then the slider butt 11 of the needle is acted upon by the slider raising cam 36, whereby the slider 5 is raised to the knit position (KL). The slider butt 11 is then allowed to pass a level above the slider guide cam 42, and thus knitting is performed.

(3) With the stitch transfer position raising cam 37 kept at its retracted position (O), both the side and center presser cams 45,46 controlled to full pressing position (f) are caused to act upon the butts 26 of selector jacks 22 at any selected one of the three positions (I), (II), and (III), whereby both the butts 14 of the bodies and the slider butts 11 of the compound needles 1 in the corresponding needle tricks 20 are kept inoperative relative to any of the raising cams 32, 36, 37 and thus the needles may be kept at their welt position.

(4) With the stitch transfer position raising cam 37 kept at its retracted position (O), side presser cams 45 controlled to full pressing position (f) and center presser cams 46 controlled to half pressing position (h) are caused to act upon the butts 26 of selector jacks 22 at any selected one of the three positions (I), (II), and (III), and each of the butts 14 of needle bodies of the compound needles in the corresponding needle tricks 20 is guided into the space 40, whereupon the stitch receiving position raising cam 41 is caused to act upon the butt 14 of the needle body so that the compound needle 1 is allowed to enter the stitch receiving course (REC) which joins the tucking course (TC). Thus, the needle 1 is able to receive a stitch 52 from another compound needle 1 raising to the stitch transfer position (TRL) on the opposite needle bed. The butt 14 of needle body of the compound needle 1 is lowererd along the tucking course (TC) by the action of the center guide cam 35 and of the stitch cam 34, and the slider butt 11 of the needle is lowered along the tucking course (TC) by the action of lowering cam face 42*b* of the slider guide cam 42. In this case, therefore, the compound needle 1 performs stitch receiving, such that the transferred stitch 52 is received just as tucked onto an old stitch which has been carried by the needle.

(5) With the stitch transfer position raising cam 37 kept in projection to half height (H), both the side presser cams 45 and the center presser cams 46 are controlled to their respective retracted positions (O) so that they are prevented from acting upon the butts 26 of selector jacks 22 at any selected one of the three positions (I), (II), and (III). Each of the butts 14 of needle bodies of the compound needles 1 in the corresponding needle tricks 20 is then acted upon by both the tuck position raising cam 32 and the stitch transfer position raising cam 37 so that it is raised to the stitch transfer position (TRL) for stitch transfer.

Again, the flat knitting machine having compound needles in accordance with the present invention performs well in the following case. For example, where the height of the slider butt 11 is set at full height (F), which height does not permit the butt 11 to sink completely into the needle trick 20 unless the butt 14 of the needle body is fully depressed into the needle trick 20, and even if the height of the slider raising cam 36 in projection above the cam plate 31 is variable between full height (F) and half height (H), at which the cam 36 does not act upon the butt 14 of the needle body if the butt 14 is half depressed into the needle trick 20, with the height of the stitch transfer position raising cam 37 set at half height (H) in projection above the cam plate 31, any selected compound needles 1 may be guided into various courses are required for knitting, tucking, or receiving stitches, or may be held in welt position (FIGS. 13 and 14). That is:

(1) With the slider raising cam 36 controlled to full height (F), each of the side presser cams 45 controlled to its retracted position (O), and with each of the center presser cams 46 controlled to half-pressing position (h), each of the compound needles 1 may be caused to knit which are in same needle tricks 20 as the selector jacks 22 whose respective butts 26 are selected to the position at which they are acted upon by the presser cams 45, 46.

(2) With the slider raising cam 36 controlled to full height (F), each of the side presser cams 45 controlled to its retracted position (O), and with each of the center presser cams 46 controlled to full-pressing position (f), each of the compound needles 1 may be caused to tuck which are in same needle tricks 20 as the selector jacks 22 whose respective butts 26 are selected to the position at which they are acted upon by the presser cams 45, 46.

(3) With the slider raising cam 36 controlled to full height (F), and with both the side and the center presser cams 45, 46 controlled to full-pressing position (f), each of the compound needles 1 in same needle tricks 20 as the selector jacks 22 whose respective butts 26 are selected to the position at which they are acted upon by the presser cams 45, 46 may be kept at welt position.

(4) With the slider raising cam 36 controlled to half height (H), each of the side presser cams 45 controlled to full pressing position (f), and with each of the center presser cams 46 controlled to half pressing position (h), each of the compound needles 1 in same needle tricks 20 as the selector jacks 22 whose respective butts 26 are selected to the position at which they are acted upon by the presser cams 45, 46 may be caused to perform stitch receiving.

(5) With both the side and the center presser cams 45, 46 controlled to their retracted position (O), each compound needle 1 may be caused to transfer stitches.

(Second Aspect of the Invention) In the flat knitting machine according to a second aspect of the invention, a knit position raising cam 33 which acts on the butt 14 of each needle body raising to the tuck position (TL) are provided on the cam plate 31. The knit position raising cam has a pair of raising cam faces **33*a* which acts on the butt 14 of each needle body raised by the tuck position raising cam 32 to the tuck position (TL) to raise the needle body to the knit position (KL). The knit position raising cam 33 has a half height (H) in projection above the cam plate 31, that is, one half of the projection height of the tuck position raising cam 32, or a variable height, so that a height difference may be provided between the tuck position raising cam 32 and the knit position raising cam 33 and between the knit position raising cam 33 and the stitch transfer position raising cam 37, the former mentioned having a higher projection height in the respective cases. The cam faces 33*a* of the knit position raising cam 33 are covered by the earlier mentioned center presser cams 46 in the directions of carriage movement. As is the case with the flat knitting machine in accordance with the first aspect of the invention, therefore, according to the relationship between the height of each slider butt 11 and the projection height of the slider raising cam 36 above the cam plate 31, for example, if the former is a half height (H) and the latter is a full height (F) or the former is a full hight (F) and the latter is a half hight (H), the projection height of the knit position raising cam 33 above the cam plate 31 is set at a half height (H), or if the former is a full height (F) and the latter is variable between full height (F) and half height (H), the projection height of the knit position raising cam 33 above the cam plate 31 is adapted to be variable between full hight (F) and half hight (H). In either case, it is possible to cause any selected compound needles 1 to knit, tuck, transfer, or receive a stitch, or to retain them in welt position, by setting and controlling the height of the slider raising cam 36, the height of the stitch transfer position raising cam 37, and the pressing positions of the side and center presser cams 45, 46 in same manner as described with the first aspect of the invention (see FIGS. 19 to 22**).

The flat knitting machine in accordance with the invention has a pair of slider guide cams 42, each for acting on the butt 11 of the slider of each compound needle 1, whose needle body 3 has been raised by the tuck position raising cam 32 to the tuck position (TL), to lower the slider 5 slightly on the tuck course (TC) as the needle body 3 begins to descend, and a slider raising cam 36, having a pair of raising cam faces **36*a* for acting directly on the butt 11 of each relevant slider to raise the slider 5 to a level slightly above the position up to which the slider 5 may be raised indirectly by the tuck position raising cam 32 and/or by the knit position raising cam 33 as its butt 14 is acted upon thereby, and to allow the slider butt 11 so raised to pass a level one of the slider guide cams 42 (which fact is applicable to both the first and the second aspects of the invention). Therefore, it is possible to cause any selected compound needles 1** to knit and to cause any other selected compound needles to tuck or perform stitch transfer in the following manner:

On the compound needle 1 selected to knit, on one hand, the needle body 3 raised to the tuck position (in the case of the knitting machine according to the first aspect of the invention wherein no knit-position rising cam 33 is present) may not be raised further, or the needle body 3 (in the case of the second aspect of the invention wherein knit position raising cam is present) may not be raised so much beyond the tuck position (TL), but in either case, only at the moment of knitting, only the slider 5 is slightly raised further, on the needle body 3 raised to the tuck position (TL) (the first aspect) or the knit position (KL) (the second aspect), by the action of the slider raising cam 36, whereby the latch portion 4 of the slider 5 is positioned in an old stitch 50 held on the needle body 3 outside the hook portion 17 thereof and the butt 11 of the slider is raised to a position which permits it to pass above one of the slider guide cams 42, so that a newly fed stitch 51 may be received into the hook portion 17 of the compound needle 1. In this conjunction, the compound needle 1 functions in such way that even when the needle body 3 begins to descend through the action of the lowering cam face 35*a* of the center guide cam 35 and/or the lowering cam face 34*a* of the stitch cam 34, both of which act on the butt 14 of the needle body 3, the butt 11 of the slider passes above the slider guide cam 42, and that even when the slider tends to descent, the butt 11 of the slider keeps contact with the upper face 42*a* of the slider guide cam 42, so that the slider is held in a predetermined elevated position. Accordingly, when the needle body 3 begins to descend, the closing of the hook portion through the latch portion 4 of the slider 5 is accurately performed. This ensures accurate knocking over of the old stitch 50 placed on the latch portion 4 of the slider 5 (see FIG. 15).

On each compound needle 1 which tucks or receives a stitch through transfer, on the other hand, when the needle body 3 raised to the tuck position (TL) begins to descend through the action of the lowering cam face 35*a* of the center guide cam 35 and/or the lowering cam face 34*a* of the stitch cam 34, both of which act on the butt 14 of the needle body 3, the slider 5 is initially lowered in conjunction with the needle body 3 through the action of the lowering cam face 42*b* of the slider guide cam 42. Therefore, when the hook portion 17 of the compound needle 1 receives into it a stitch 51 fed or a stitch 52 transferred, the hook portion 17 is accurately kept open until an old stitch 50 held in position on the needle body 3 outside the hook portion 17 is again introduced into the hook portion 17 as the needle body 3 descends (see FIGS. 16 and 17).

Where the knit position raising cam 33 is provided in accordance with the second aspect of the invention, even if the raising stroke of the tuck position cam 32 and the longitudinal stroke of the slider 5 which is limited relative to the needle body 3 are set somewhat smaller as compared with those in the case of the first aspect of the invention where no knit-position raising cam 33 is provided (for example, each by one half of the raising stroke of the knit position raising cam), the latch portion 4 of the slider 5 may be positioned in the old stitch 50 placed outside the hook portion 17 of the needle body 3 during knitting operation, and furthermore, the butt 11 of slider of each compound needle 1 which is performed knitting and the slider butt 11 of each compound needle 1 which has performed tucking may be accurately guided respectively to the upperside of and to the underside of the slider guide cam 42.

BRIEF DESCRIPTION OF THE DRAWINGS

FIGS. 1 to 17, inclusive, illustrate one embodiment of the flat knitting machine in accordance with the first aspect of the present invention.

FIG. 1 is a longitudinal sectional view in side elevation of a needle bed;

FIG. 2 is a longitudinal section in side elevation of the needle bed in FIG. 1, with a compound needle shown as it appears when bent;

FIG. 3 is a side view showing a slider;

FIG. 4 is a side view showing a needle body;

FIG. 5 is a section taken on the line V—V in FIG. 3;

FIG. 6 is a section taken on the line VI—VI in FIG. 4;

FIG. 7 is a plan view showing a portion of a cam plate;

FIG. 8 is an expanded view in plan showing a slider guide cam;

FIG. 9 is a sectional view thereof (section taken along the line IX—IX in FIG. 8);

FIG. 10 is a side view thereof;

FIGS. 11 and 12 are partial views in plan of same cam plate as in FIG. 7, showing courses of movement for butts of needle bodies and for butts of sliders respectively;

FIGS. 13 and 14 are partial view in plan of same cam plate as in FIG. 7, showing courses of movement for butts of needle bodies and of sliders respectively in another embodiment;

FIGS. 15(*a*) to (*e*) are views illustrative of various aspects of knitting operation;

FIGS. 16(*a*) to (*e*) are views illustrative of various aspects of tucking operation;

FIGS. 17(*a*) to (*e*) are views illustrative of various aspects of transfer operation;

DESCRIPTION OF THE PREFERRED EMBODIMENT

Figure 1:
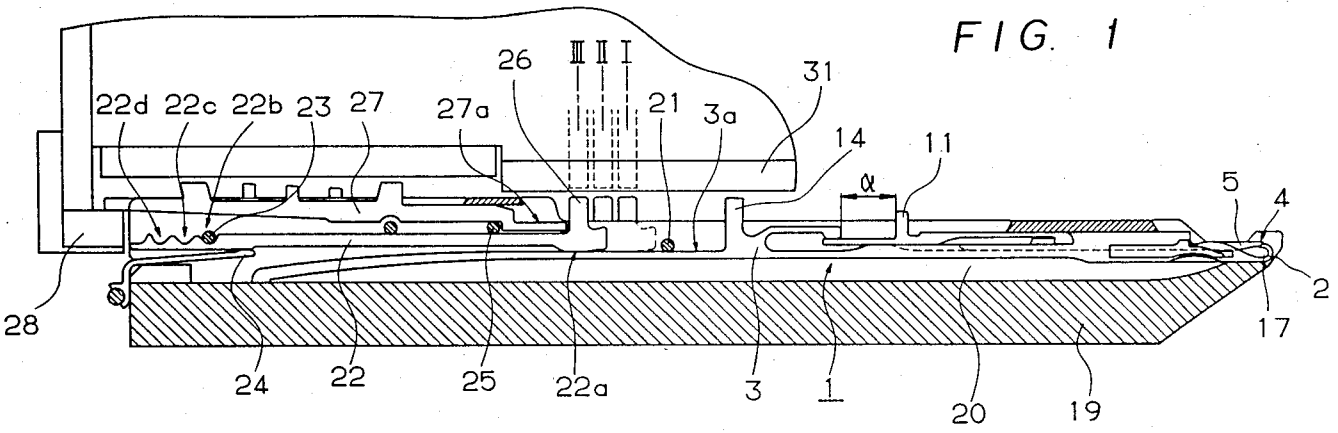

One embodiment of the invention according to its first aspect will be described with reference to FIGS. 1 to 17, inclusive. In accordance with the invention, each compound needle 1 comprises a needle body 3 having a hook 2 at its front end, as illustrated in FIGS. 4 and 6, and a slider 5 having a latch portion 4 at its front end, as illustrated in FIGS. 3 and 5. The needle body 3 has a groove 6 formed in its upper portion and extending in the longitudinal direction thereof, which groove 6 is open frontward at its front end and opposite to the hook 2. The groove 6 extends backward beyond a backward fronting stepped portion 7 formed on the upper portion of the needle body 3 in its front portion, at which stepped portion 7 the groove 6 is open backward. The slider 5 is fitted in the groove 6 formed as such in the needle body 3. In this embodiment, the slider 5 comprises a shank portion 8 fitted slidably in the groove 6 and a jack portion 10 articulated 9 at its front end to the shank portion 8, the jack portion 10 having an upwardly projecting butt 11 provided thereon. At the articulated point 9, a protrusion 13 formed on the front end of the jack portion 10 is fitted into a recess 12 formed in a upper portion of the shank portion 8 so that the shank portion 8 and the jack portion 10 are articulated 9 to each other. The shank portion 8 has a thickness sized enough to permit it to slide within the groove 6 formed in the needle body 3, while on the other hand the jack portion 10 has same thickness as the needle body 3. In the state of FIG. 4 in which the shank portion 8 is fitted in the groove 6 of the needle body 3 as shown by a virtual line, if the slider 5 is caused to advance relative to the needle body 3, the slider 5 is prevented from its relative advance on the needle body 3 at a point at which the front end of the jack portion 10 collides with the backward fronting stepped portion 7 on the needle body 3.

The needle body 3 of the compound needle 1 has an upwardly projecting butt 14 provided thereon, and a frontward facing recess 15 formed in front of the butt 14, in which recess 15 a backward extending portion 10*a* of the jack portion 10 behind its butt 11 is located. The slider 5, if retreated relative to the needle body 3, is prevented from its further retreat relative to the needle body 3 at a point at which the rear end of the butt 11 collides with a jaw portion 16 of the recess 15. Accordingly, the slider 5 is back and force movable relative to the needle body 3 over only a given limited stroke $\alpha$ between an advance position at which the front end of the jack portion 10 collides with the stepped portion 7 and a retreated position at which the rear end of the butt 11 of the jack portion 10 collides with the jaw portion 16. The compound needle is designed so that if either the needle body 3 or the slider 5 is moved back and forth in excess of said limit of stroke $\alpha$ in a needle trick 20, the other is caused to move in cooperation therewith; and if the slider 5 is moved back to its most retreated position on the needle body 3, the latch portion 4 is drawn into the groove 6 of the needle body 3 to open the hook portion 17 of the needle body 3, whereas if the slider 5 is moved forward to its most advanced position on the needle body 3, the latch portion 4 strikes the front end of the hook 2 to close the hook portion 17. It is noted in this connection that the limit of stroke $\alpha$ of the slider 5 relative to the needle body 3 is slightly greater than a stroke required for the front end portion of the slider to close and open the hook portion 17, and that a stepped portion 3*b* is formed on the needle body 3 and behind the hook portion 17, with transfer blades 18 mounted to the sides of the needle body and adjacent the stepped portion 3*b*.

Figure 2:
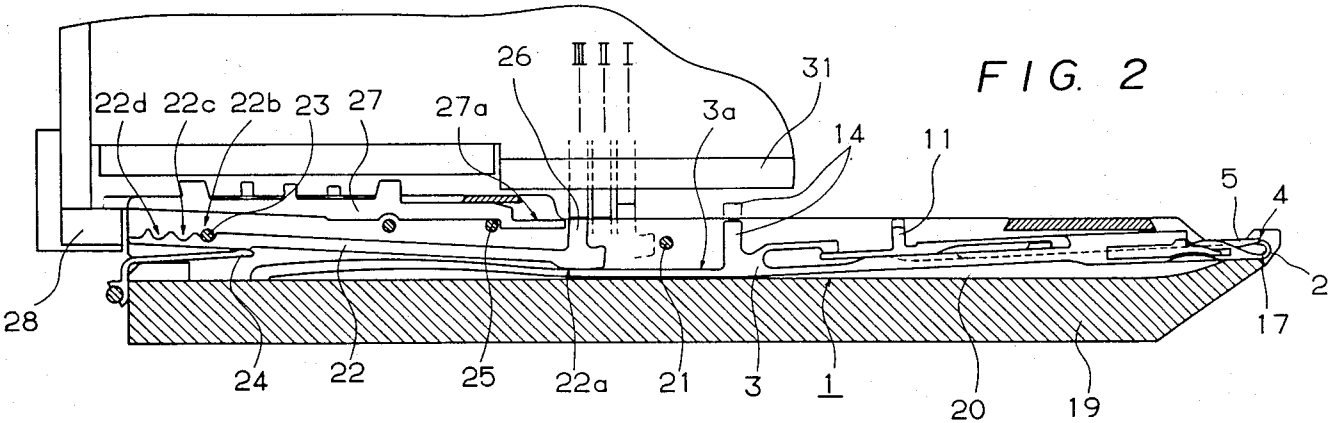

In the compound needle 1 constructed as above described, the butt 11 of the slider 5 is located before the butt 14 of the needle body. Further, the compound needle 1 in this embodiment is so flexibly constructed that even in its entirety in which the needle body 3 is combined with the slider 5, if the upper surface 3*a* of the needle body 3 behind the butt 14 thereof is pressed depthwise of the needle trick 20, the compound needle 1 which has the butts 11, 14 kept in their projected position outside the needle trick 20 in normal condition is resiliently deformed so that the butts 11, 14 may be caused to sink into the needle trick 20. When the compound needle 11 in this embodiment is in such condition as illustrated in FIG. 1 wherein no external force is present which acts on the upper surface 3*a* of the needle body 3 for depressing it into the needle trick 20, the underside of the needle body 3 adjacent the front end thereof and the rear end portion of the needle body 3 are in contact with the bottom of the needle trick 20, and the upper surface 3*a* of the needle body 3 behind the butt 14 is in contact with a stopper 21 comprised of a piano wire and extending across the needle trick 20, so that the butts 11 and 14 are kept at their respective positions, with the butt 11 projected to half height and the butt 14 projected to full height. When the upper surface 3*a* of the needle body 3 is depressed behind the stopper 21 and depthwise of the needle trick 20, as FIG. 2 illustrates, a longitudinal median portion of the needle body 3 is bent upwardly bent for depressing the butts 11, 14 into the needle trick 20. In this conjucntion, two alternative conditions may be selected according to the amount of depression: one is that the butts 11, 14 are both caused to sink fully into the needle trick 20, and the other is that the butt 14 of the needle body is depressed to half height, the slider butt 11 only being completely depressed into the needle trick 20 (FIG. 2). In this embodiment, the height of the slider butt 11 in projection above the needle trick 20 is set at a half height (H) such that it is completely depressed into the needle trick 20 if the butt 14 of the needle body is half depressed thereinto, and the needle trick 20 has a depth enough to permit the compound needle 1 to bend, when depressed on its upper surface, so that the butts 11 and 14 may be caused to sink into the needle trick 20 to the desired extent.

Nextly, control device for controlling compound needles 1 of the above described construction, housed in corresponding needle tricks, in the flat knitting machine of the invention will be described. As FIGS. 1 and 2 illustrate, a selector jack 22 whose under surface 22*a* adjacent its front end acts on the upper surface 3*a* of the the needle body 3 to press it downward is back and forth movably disposed behind and above the needle body 3 in the needle trick 20. The selector jack 22 has three small recesses 22*b*, 22*c*, 22*d* formed on the surface thereof adjacent its rear end, which recesses may be selectively brought in light engagement with a click stopper 23 comprised of a piano wire extending through the needle bed 19 across the needle trick 20, so that the selector jack 22 may be click stopped at one of three positions in the needle trick 20. The front portion of the selector jack 22 is pivotally movable about the click stopper 23. Shown by 24 is a spring urging the selector jack 22 upward for the purpose of click stopping, and shown by 25 is a stopper for preventing the float of front portion of the selector jack 22 under the force of the spring 24. The stopper 25 is comprised of a piano wire extending through the needle bed 19 across the needle trick 20.

The selector jack 22 has a butt 26 projecting upwardly from the upper surface of its front portion. In the needle trick 20, the butt 26 is positioned at one of the three positions, advanced position (I), intermediate position (II), and retreated position (III), depending upon which one of the three recesses 22*b*, 22*c*, 22*d* may be selected for engagement of the selector jack 22 with the click stopper 23.

In the needle trick 20 and behind the butt 26 of the selector jack 22 there is back and forth movably disposed a selector 27 which acts on the selector jack 22 to push it upward when its front end portion 27*a* strikes the rear end of the butt 26, the rear portion of the selector 27 being pivotally movable about the stopper 25. This selector 27 is of such type that if only selectors 27 selected by an array of electrical selector devices, not shown, on a carriage are brought to the operative zone of a selector raising cam (not shown) on the carriage and are moved forward through the action of the raising cam, each of the selectors 27 pushes a selector jack 22 in the corresponding needle trick 20 to advance it from the retreated position (III) to the advanced position (I). Since such selector device is known, description of details thereof is omitted herein. The butts 26 of selector jacks 22 brought to the advanced position (I) by the action of the selectors 27 are lowered to the intermediate position (II) by a half clear cam 29, shown in FIG. 7, on the carriage, and are then selectively lowered by a clear cam 30 to the retreated position (III).

Figure 7:
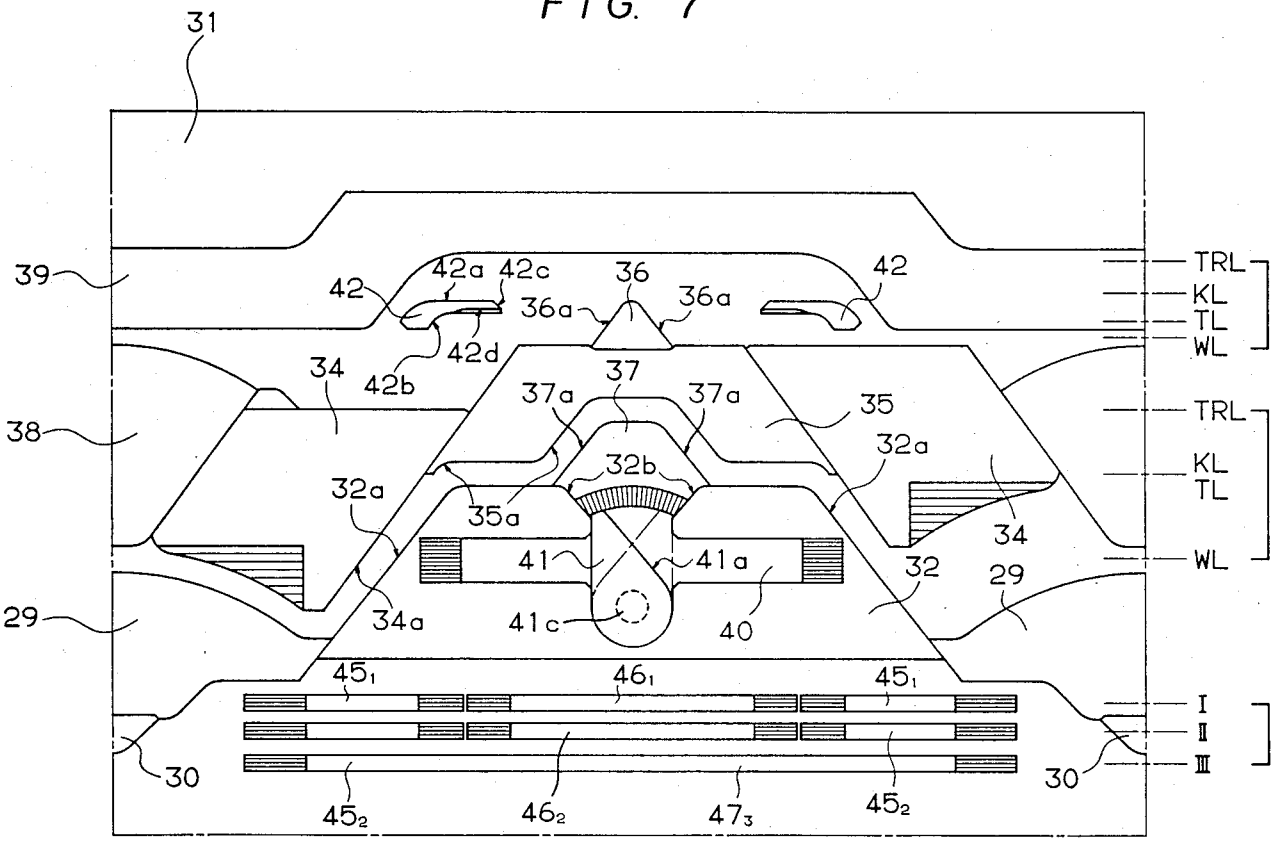

Nextly, description will be made of cam devices on the carriage which act on the compound needles 1 and selector jacks 22 arranged as above described. FIG. 7 is a view illustrating a portion cut away from a cam plate 31 on the carriage. For the purpose of better understanding, cam slopes acting on the top of each butt are shown with lines extending in their respective sloping directions. On the cam plate 31 there are disposed knitting and transfer locks at same phases in the directions of movement of the carriage. Each knitting lock comprises of tuck position raising cam 32 having a pair of cam faces 32*a* for acting on the butt 14 of each needle body at welt position (WL) to raise the needle body 3 to tuck position (TL), a center guide cam 35 for acting on the butt 14 of the needle body raised to tuck position (TL) to lower it to the operative position of a next following stitch cam 34, a pair of stitch cams 34 for acting on the butt 14 of the needle body, a pair of slider guide cams 42 each having a lowering cam face 42*b* for acting on the butt 11 of the slider 5 raised to the tuck position (TL) to lower the compound needle 1 along tucking course (TC), and a slider raising cam 36 having a pair of raising cam faces 36*a* for acting on the butt 11 of the slider 5 of the compound needle 1 raised to the tuck position (TL), at a point ahead of the slider guide cam 42 in the direction of movement of the carriage, to raise the butt 11 of the slider to a level at which the butt 11 is allowed to pass above the slider guide cam 42. In this embodiment, the tuck position raising cam 32, the center guide cam 35, and the slider raising cam 36 are respectively composed of integral blocks. The height of slider raising cam 36 in projection above the cam plate 31 is set to full height (F) so that the slider raising cam 36 may be caused to act on the butt 11 of the slider which is set at half height (H), when the needle body 3 is not bent.

The slider guide cams 42 each has a upper cam face 42*a* for acting on the butt 11 of slider of each compound needle 1, whose needle body 3 has been raised to tuck position (TL) by the action of the tuck position raising cam 32 and whose slider 5 has been raised to knit position (KL) by the action of the slider raising cam 36, to hold the slider 5 in the specified raised position, and a lowering cam face 42*b* for acting on the butt 11 of slider of each compound needle 1, whose needle body 3 has been raised to tuck position (TL) by the action of one of the tuck raising cams 32, to lower the slider 5 slightly along the tucking course. In this embodiment, as FIGS. 8 to 10 illustrate, each of the slider guide cams 42 has, on its slider butt receiving side in the direction of movement of the carriage, a raising cam face 42*c* fronting the direction of carriage movement and a slope 42*d* facing the needle bed. It is noted that said lowering cam face 42*b* is parallel to the lowering cam face 35*a* of the center guide cam 35. Shown by 38 and 39 are guide cams, both fixed to the cam plate 31.

Each transfer lock comprises stitch transfer position raising cam 37 disposed above the tuck position raising cam 32, spaces 40 formed in the tuck position raising cam 32 and at aforesaid welt position (WL) between the pair of raising cam faces 32*a* of said raising cam 32, a stitch receiving course raising cam 41 disposed in said space 40, a stitch receiving course (REC) (see FIG. 12) leading from said space 40 to the tucking course (TC) (see FIG. 11), and said center guide cam 35 having a lowering cam face 35*a* for acting on the butt 14 of each needle body raised to the stitch transfer position (TRL), to lower it to the operative position of the stitch cams 34. In this embodiment, the projection height of the stitch transfer position raising cam 37 above the cam plate 31 is variable between half height (H), or a height equal to one half of the projection height of the tuck position raising cam 32, and retracted position (O). The stitch receiving course raising cam 41 is a movable cam having its base 41*c* pivotally supported on the cam plate 31 for displacement between a position shown by a solid line and that shown by a chain line. The stitch receiving course (REC) for acting on the butt 14 of a needle body to raise the needle body from the space 40 to the tuck position (TL) comprises a pair of cam faces 41*a* of the stitch receiving course raising cam 41, and a pair of raising cam faces 32*b* consisting upper surface portions of the tuck position raising cam 32 which front toward the stitch transfer position raising cam 37. The stitch receiving course (REC) leads crosswise from the spaces 40 on both sides of the stitch receiving course raising cam 41 to the tucking course (TC).

On the cam plate 31 in this embodiment there are disposed retractable presser cams $45_1$, $45_2$, $46_1$, $47_3$ which act on the butts 26 of selector jacks 22 selected to three positions (I), (II), (III) as above mentioned, to press them downward. Presser cams $45_1$, $46_1$ are disposed in the operative courses relative to the butts 26 of selector jacks 22 in the advanced position (I).

Presser cams $45_2$ are disposed in the operative courses relative to the butts 26 of selector jacks 22 in the intermediate position (II). Presser cam $47_3$ is disposed in the operative course relative to the butts 26 of selector jacks 22 in the retreated position (III). Presser cams $45_1$, $45_2$ each is a presser cam provided at a phase covering at least a beginning portion of each tuck position raising cam 32 in the direction of carriage movement. Presser cam $46_1$ is a center presser cam disposed at a phase covering all the respective raising cam faces 36*a*, 37*a*, and 41*a* of the slider raising cam 36, stitch transfer position raising cam 37, and stitch receiving course raising cam 41 in the direction of carriage movement. Presser cam $47_3$ is a combination side and center presser cam provided at a phase covering all phases of side presser cams $45_1$, $45_2$ and center presser cam $46_1$ in the direction of carriage movement. The center presser cam $46_1$ is variable between a half pressing position (H) at which the butt 26 of a selector jack 22 is acted upon for half depression into the corresponding needle trick 20 and the retracted position (O) at which the butt 26 is not acted upon. The side presser cams $45_1$, $45_2$ and the combination side and center presser cam $47_3$ are variable between a full pressing position (f) at which the butt 26 of a selector jack 22 is acted upon for full depression into the corresponding needle trick 20 and the retracted position (O) at which the butt 26 is not acted upon.

CONTROL TABLE (1)

| | 1 | | | | | | 2 | | | | | |
|---|---|---|---|---|---|---|---|---|---|---|---|---|
| Height of slider butt 11 | | H | (or) | F | | | | | F | | | |
| Height of slider raising cam 36 | | F | | H | | | | F | | | H | |
| Height of stitch transfer position raising cam 37 | | | O | | | H | | | | H | | |
| Selected position of selector jack 22 | I | II | III | I | II | III | I | II | III | I | II | III |
| Pressing position of side presser cam 45 | 0 | 0 | f | f | | 0 | 0 | 0 | f | f | | 0 |
| Pressing position of center presser cam 46 | h | 0 | f | h | | 0 | h | f | f | h | | 0 |
| Course for passage of compaund needle 1 | TC | KC | WC | REC | | TRC | KC | TC | WC | REC | | TRC |

Figure 11:
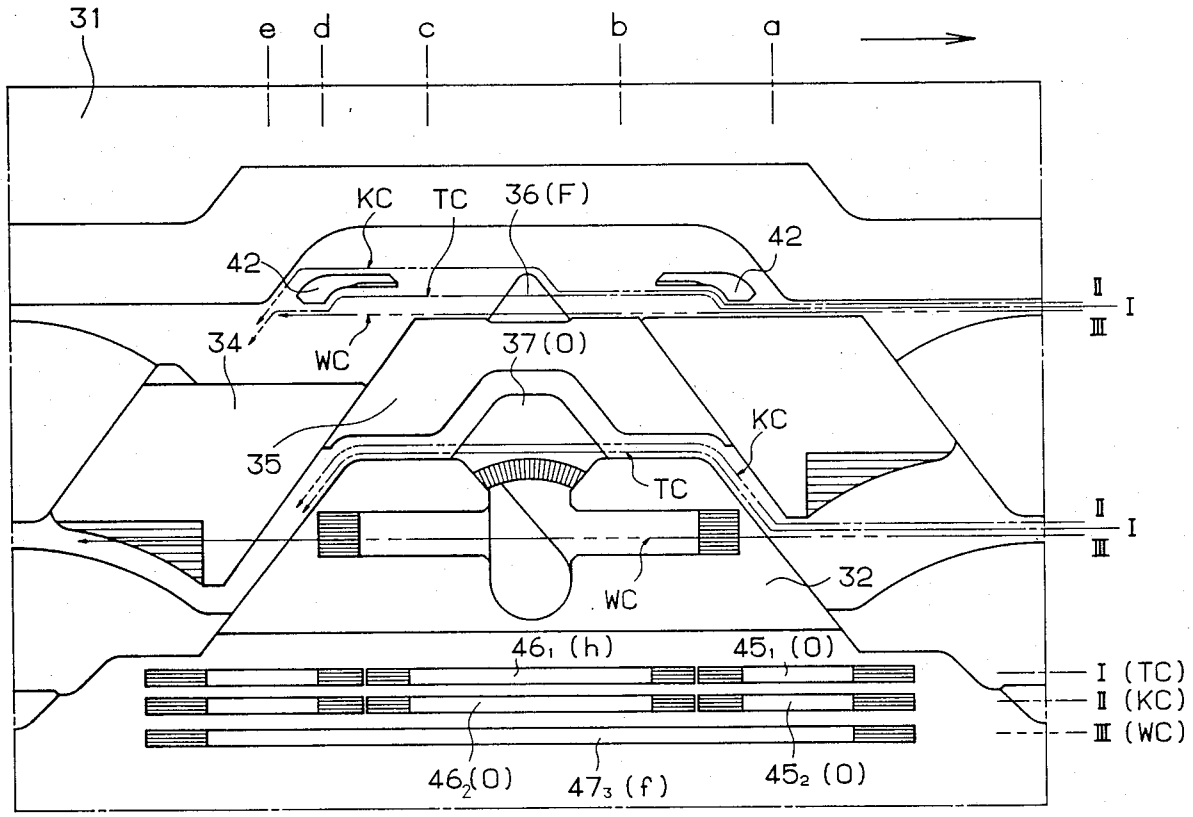
Figure 12:
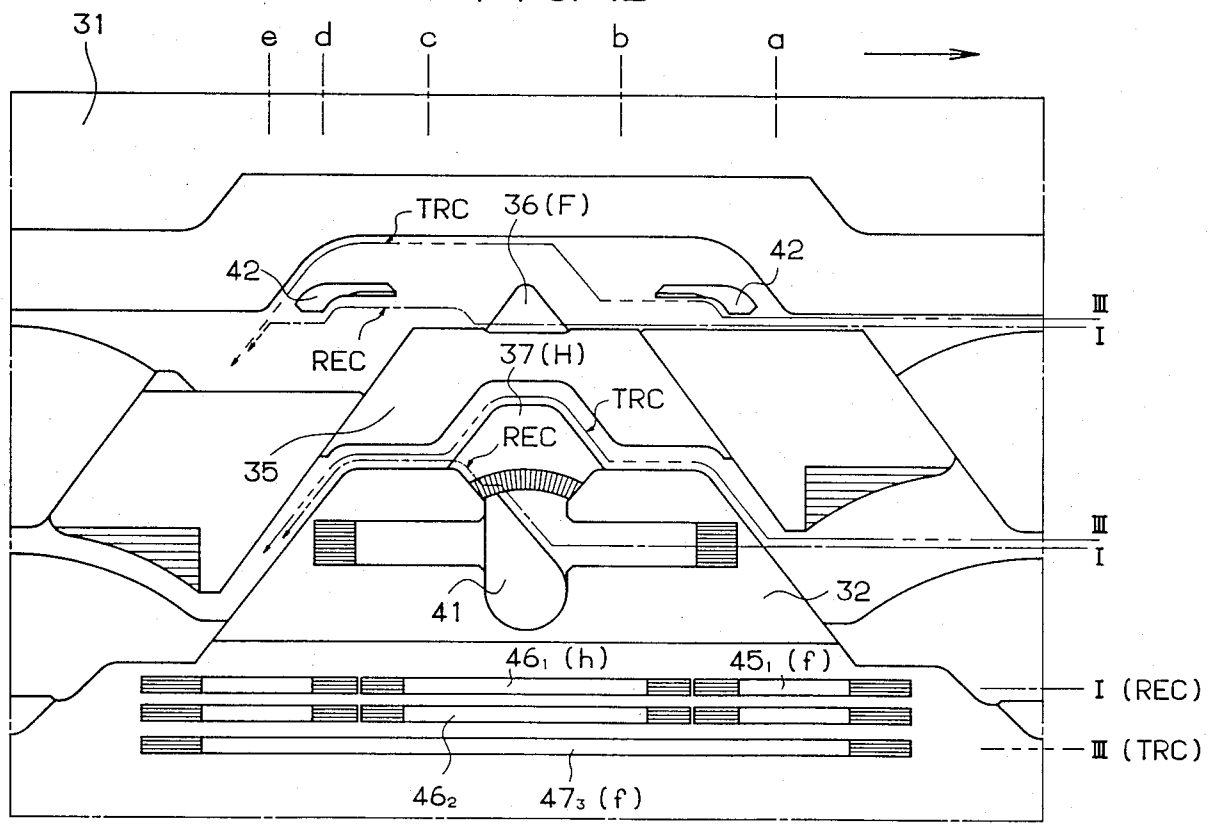
Figure 13:
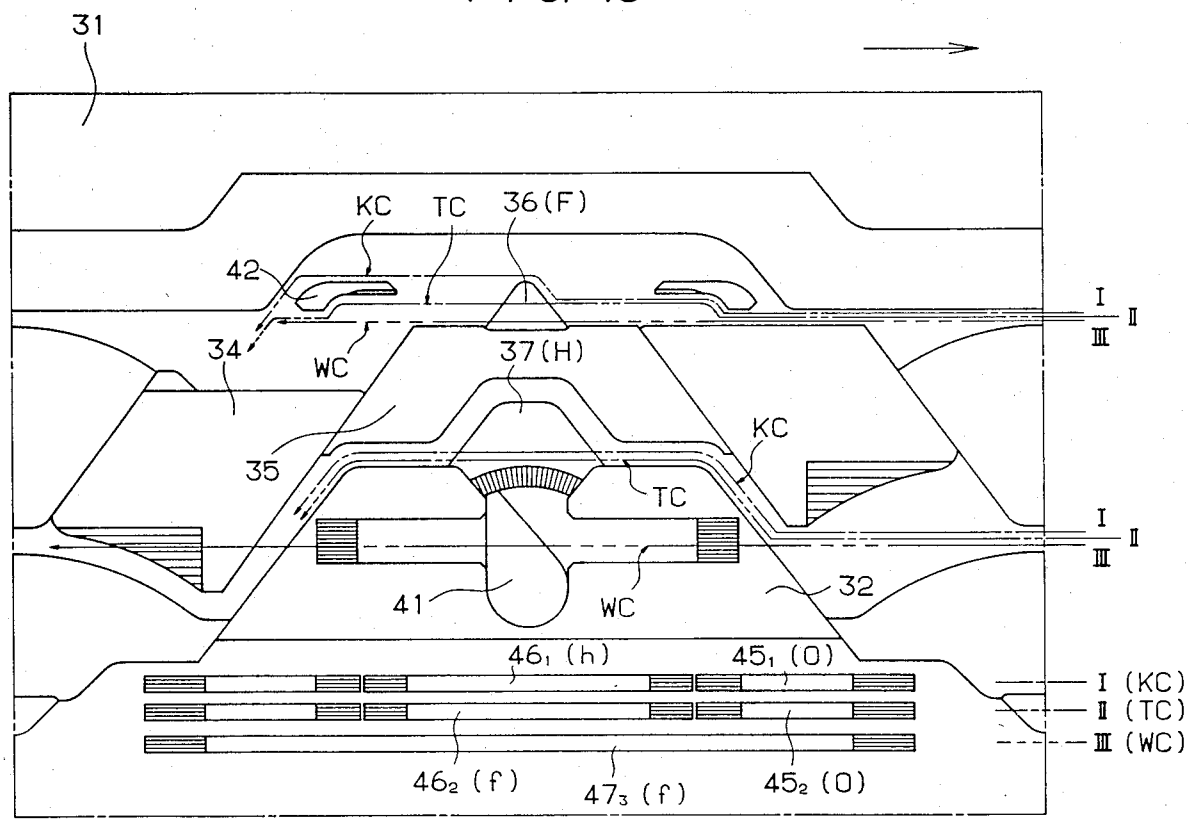
Figure 14:
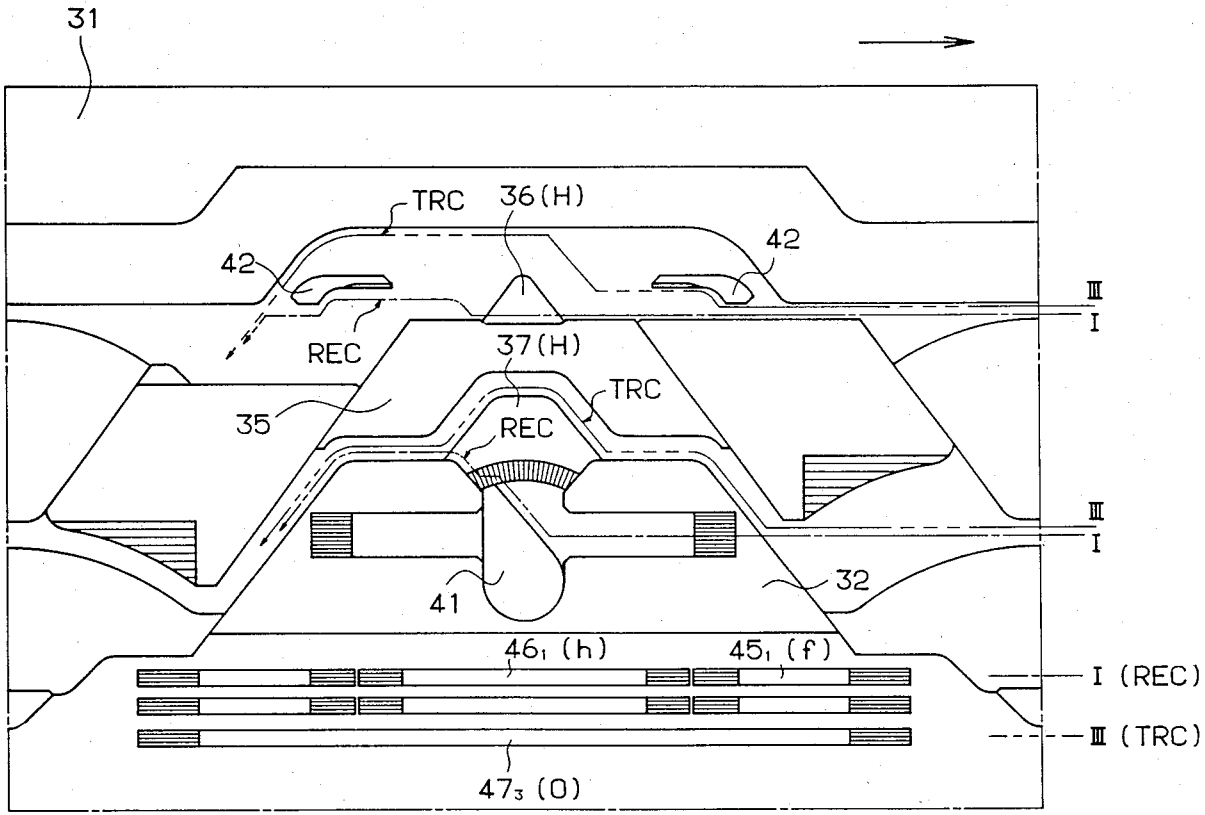

Since the slider butts 11, slider raising cam 36, stitch transfer position raising cam 37, and the presser cams $\mathbf{45}_1$, $\mathbf{45}_2$, $\mathbf{46}_1$, $\mathbf{47}_3$ are arranged as above described in this embodiment, it is possible to selectively guide any compound needles 1 to the knitting course (KC), the tucking course (TC), the welt course (WC), the stitch transfer course (TRC), or the stitch receiving course (REC) as indicated under column 1 in Control Table 1 above by selecting the butts 26 of any selector jacks 22 to one of the three positions (I), (II), (III), the stitch transfer position raising cam 37 to either the half position (H) or the retracted position (O), and the side presser cams $\mathbf{45}_1$, $\mathbf{45}_2$, the centere presser cams $\mathbf{46}_1$, $\mathbf{46}_2$, and the side and center combination presser cam $\mathbf{47}_3$ at the three positions (I), (II), (III) individually to one of the pressing positions (f), (h) or retracted position (O) as indicated in said column 1 (see FIGS. 11 and 12).

Figure 15:
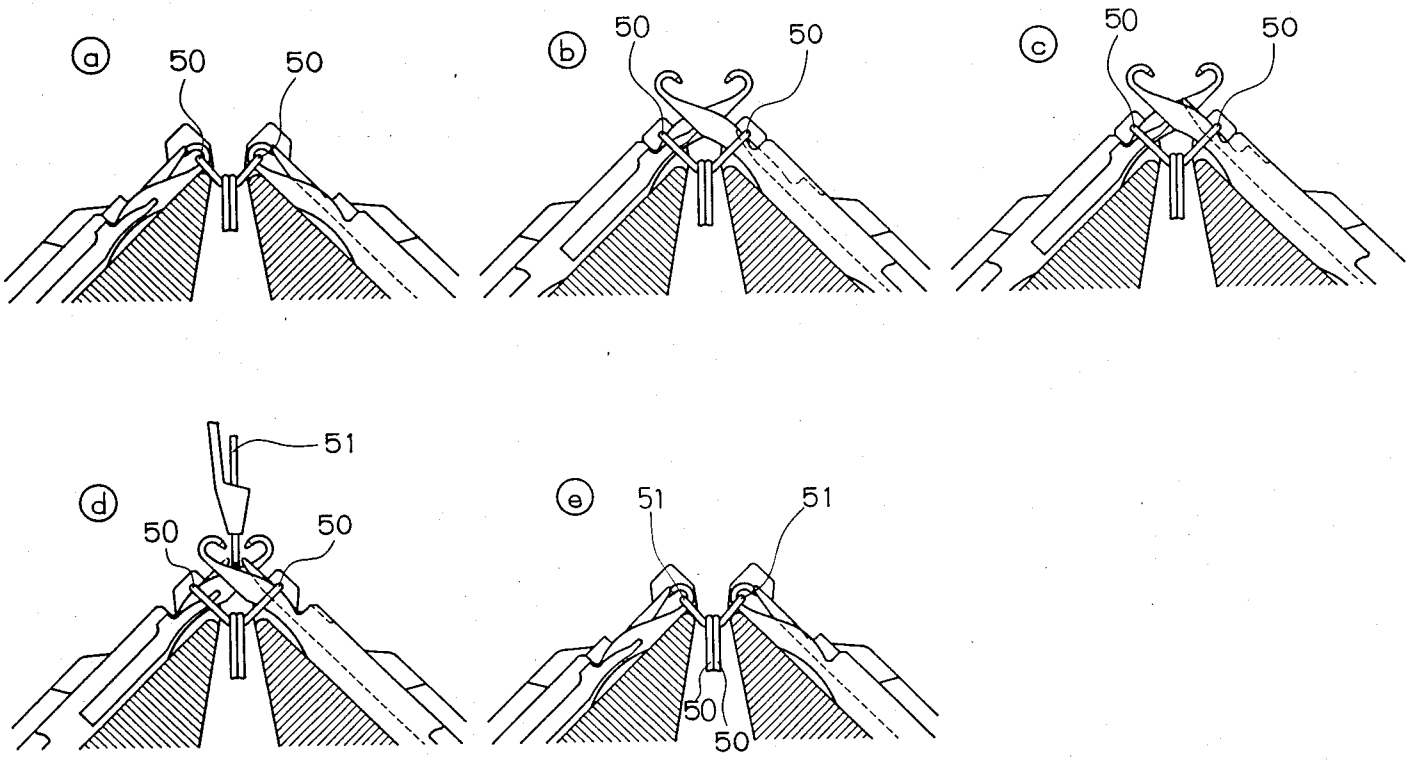
Figure 16:
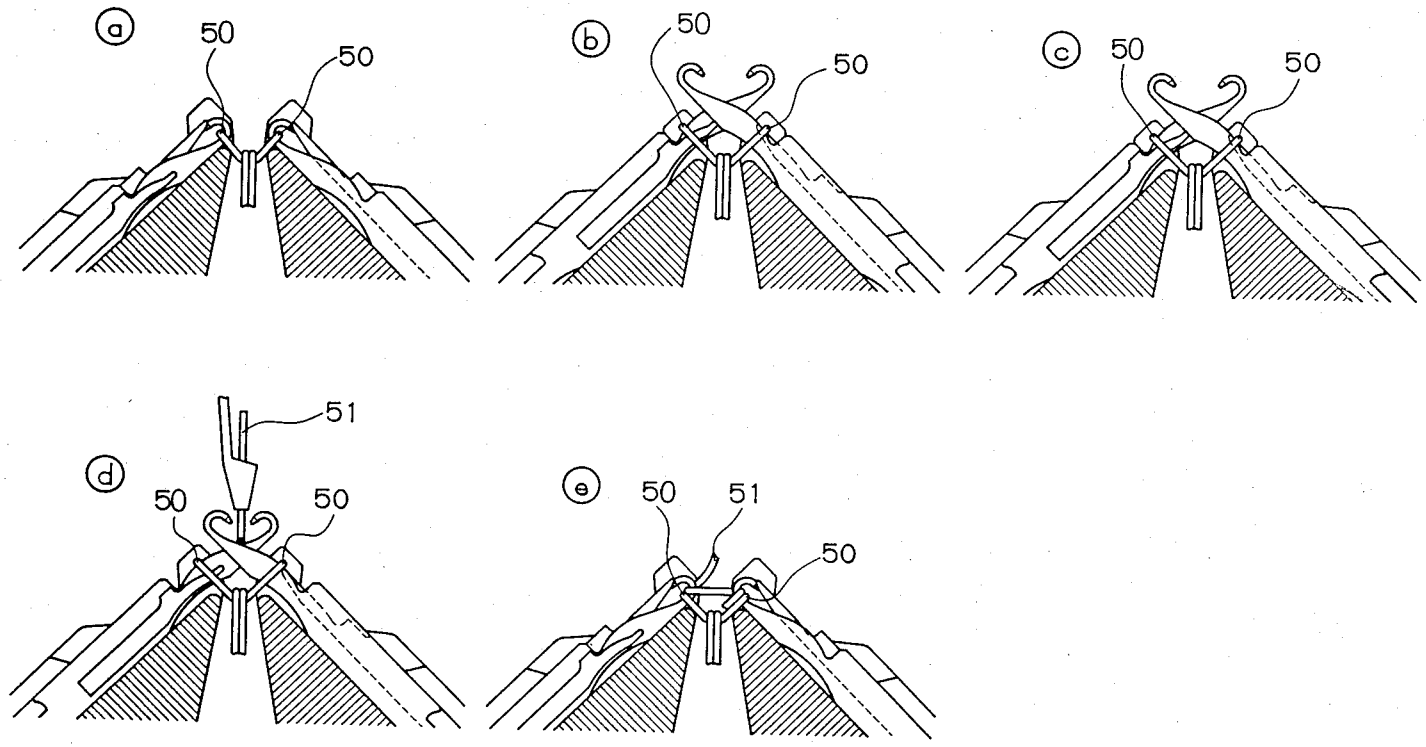
Figure 17:
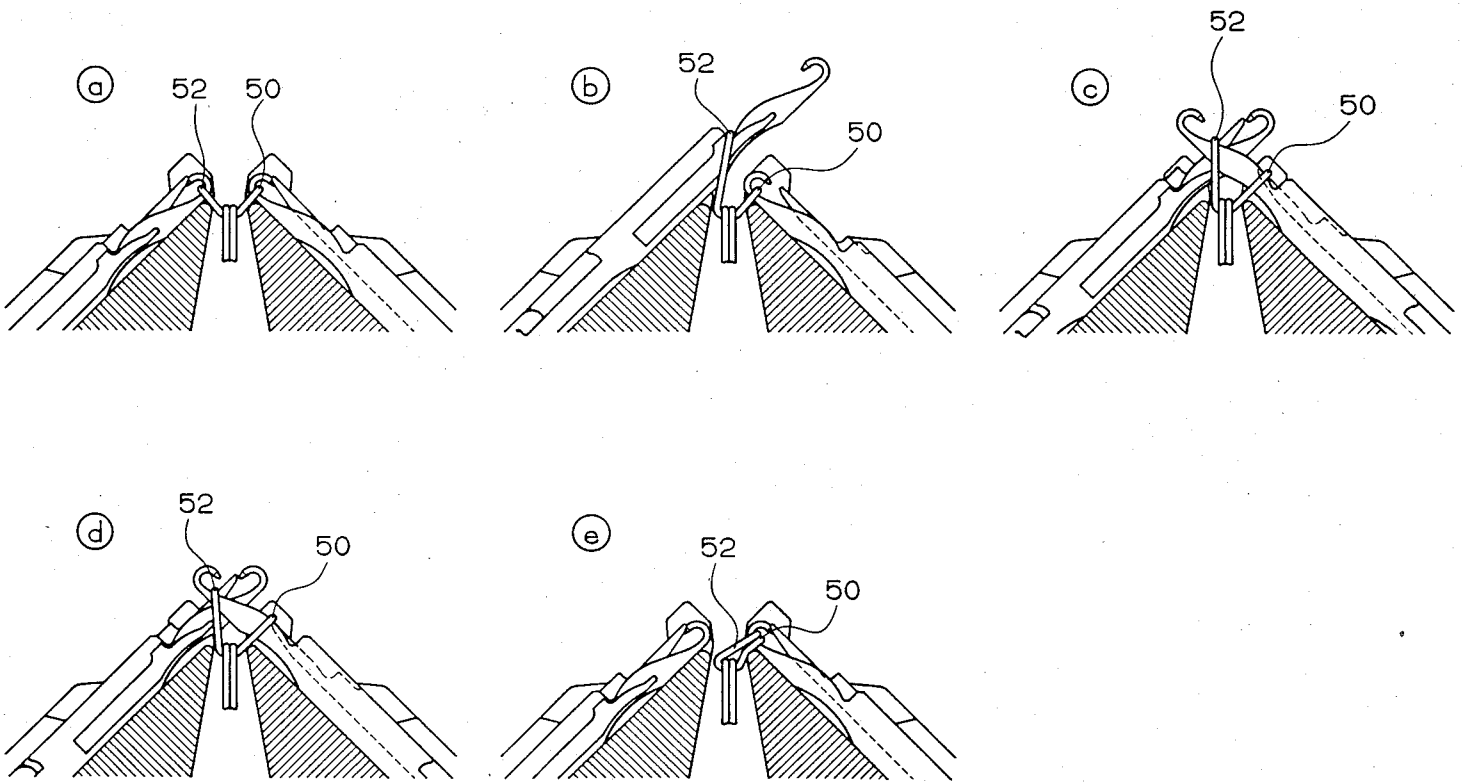

Each compound needle 1 guided to each of the courses is illustrated explodedly in time sequence as it appears in the course in FIGS. 15 to 17, inclusive. FIG. 15 is an exploded view showing the compound needle 1 as it appears when knitting; FIG. 16 is an exploded view showing the needle 1 as it appears when tucking; and FIG. 17 is an exploded view showing the needle 1 as it appears when performing stitch receiving work. In these drawings, numeral 50 denotes an old stitch, numeral 51 denotes a newly fed yarn, and numeral 52 denotes a stitch transferred. It is also noted that characters a~e affixed to FIGS. 15, 16 and 17 correspond to the phases a~e shown in FIGS. 11, 12.

Nextly, another embodiment of the invention according to its first aspect will be explained. In the flat knitting machine having compound needles in accordance with the invention, wherein the projection height of each slider butt 11 above the corresponding needle trick 20 is set at full height (F) at which the slider butt 11 will not be caused to sink fully into the needle trick 20 unless the butt 14 of the needle body is completely depressed into the needle trick 20, even if the height of slider raising cam 36 is variable between full height (F) and half height (H), with the stitch transfer position raising cam 37 set at half height (H), it is possible to guide any compound needles 1 selectively to the knitting course (KC), the welt course (WC), the stitch transfer course (TRC), or the stitch receiving course (REC) as indicated under column 2 in Control Table (1), by selecting the butts 26 of any selector jacks 22 to one of the three positions (I), (II), (III), the height of the slider raising cam 36 to either full height (F) or half height (H), and the side presser cams $\mathbf{45}_1$, $\mathbf{45}_2$, center presser cams $\mathbf{46}_1$, $\mathbf{46}_2$, and side and center combination presser cam $\mathbf{47}_3$ at three positions (I), (II), (III) individually to one of the pressing positions (f), (h) or the retracted position (O) (see FIGS. 13 and 14).

Reference is now made to FIGS. 18 to 23, inclusive, which show embodiments in accordance with a second aspect of the invention. As may be seen from FIG. 18, the flat knitting machine according to the second aspect of the invention differs from the one according to the first aspect in that a knit position raising cam 33 are disposed above the tack position raising cam 32, the knit position raising cam 33 having raising cam faces **33*a* for acting on the butt 14 of each needle body, which has been raised to the tucking position (TL) through the action of one of the cam faces 32*a* of the tuck position raising cam 32, to raise the needle body 3 further to the knitting position (KL); and in that the phases of these raising cam faces 33*a* of the knit position raising cam 33 in the directions of carriage movement are covered by the center presser cams 46. In this conjunction, it is noted that a proper difference is provided between the tuck position raising cam 32 and the knit position raising cam 33 and between the knit position raising cam 33 and the stitch transfer position raising cam 37 so that compound needles 1** many be controlled in same manner as in the case of the embodiments according to the first aspect of the invention.

CONTROL TABLE (2)

| | 1 | | | | | | 2 | | | | | |
|---|---|---|---|---|---|---|---|---|---|---|---|---|
| Height of slider butt 11 | | H | (or) | F | | | | | F | | | |
| Height of slider raising cam 36 | | F | | H | | | | | F | | H | |
| Height of stitch transfer position raising cam 37 | | | O | | | H | | | H | | | |
| Height of knit position raising cam 33 | | | H | | | | | F | | | H | |
| Selected position of selector jack 22 | I | II | III | I | II | III | I | II | III | I | II | III |
| Pressing position of side presser cam 45 | 0 | 0 | f | f | | 0 | 0 | 0 | f | f | | 0 |
| Pressing position of | h | 0 | f | h | | 0 | h | f | f | h | | 0 |

CONTROL TABLE (2)-continued

| | 1 | | | | | 2 | | | | |
|---|---|---|---|---|---|---|---|---|---|---|
| center presser cam 46 | | | | | | | | | | |
| Course for passage of compaund needle 1 | TC | KC | WC | REC | TRC | KC | TC | WC | REC | TRC |

Figure 18:
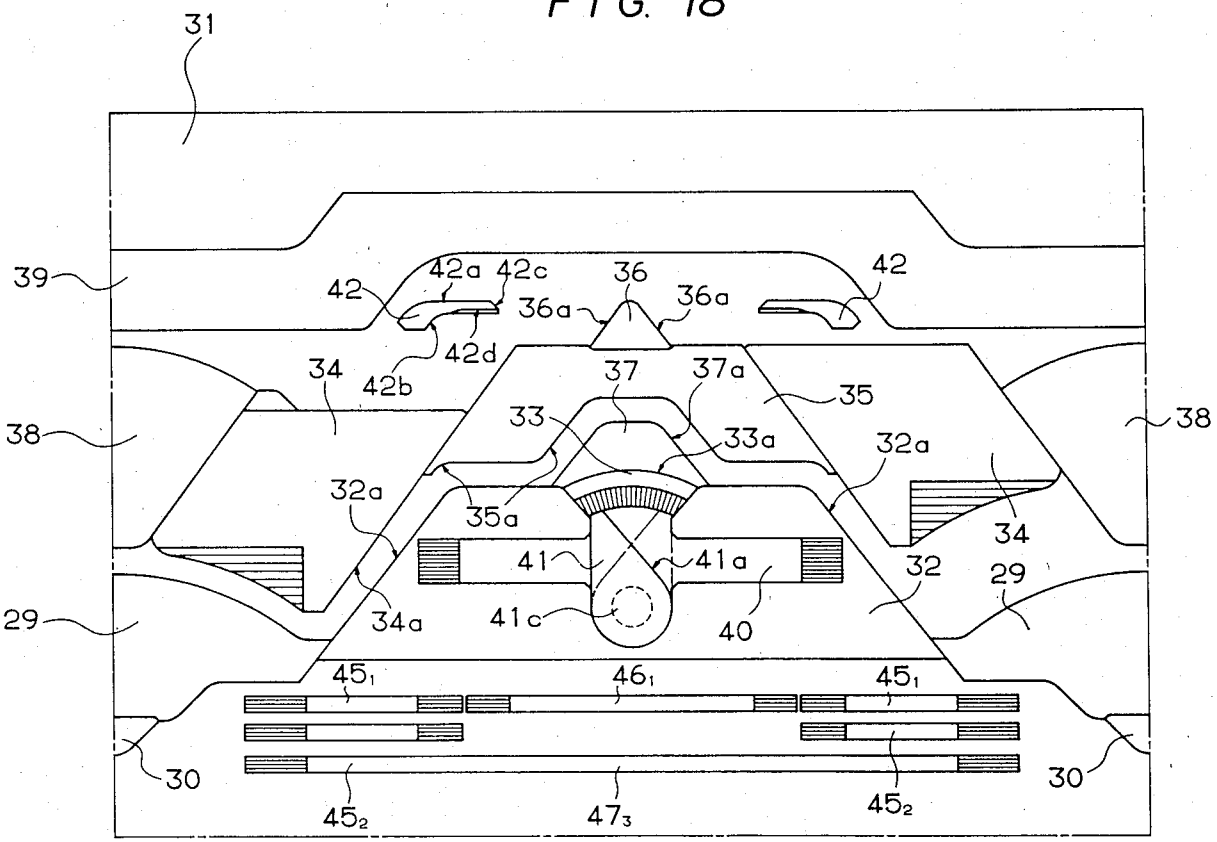
FIG. 18 is a plan view showing one portion of a cam plate in one embodiment according to a section aspect of the present invention.
Figure 19:
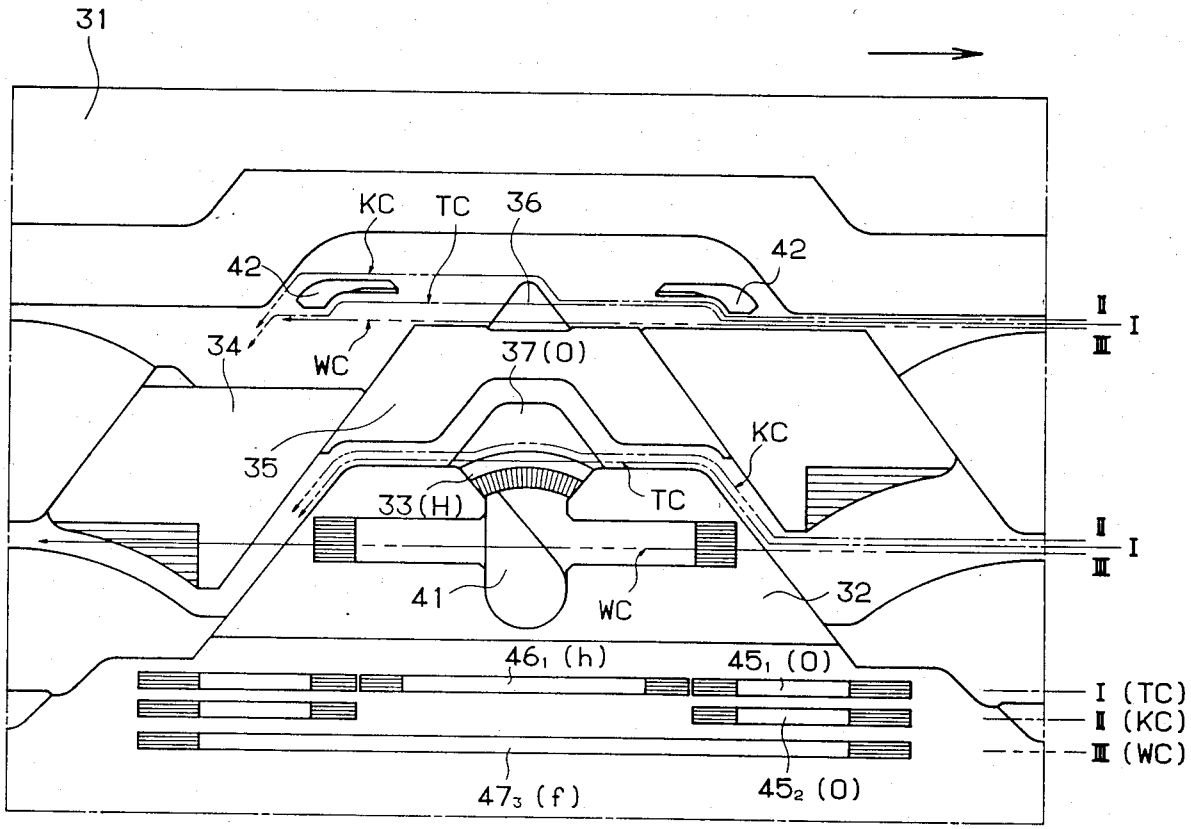
FIGS. 19 and 20 are partial views in plan of same cam plate as in FIG. 18, showing courses of movement for butts of needle bodies and for butts of sliders respectively.
Figure 20:
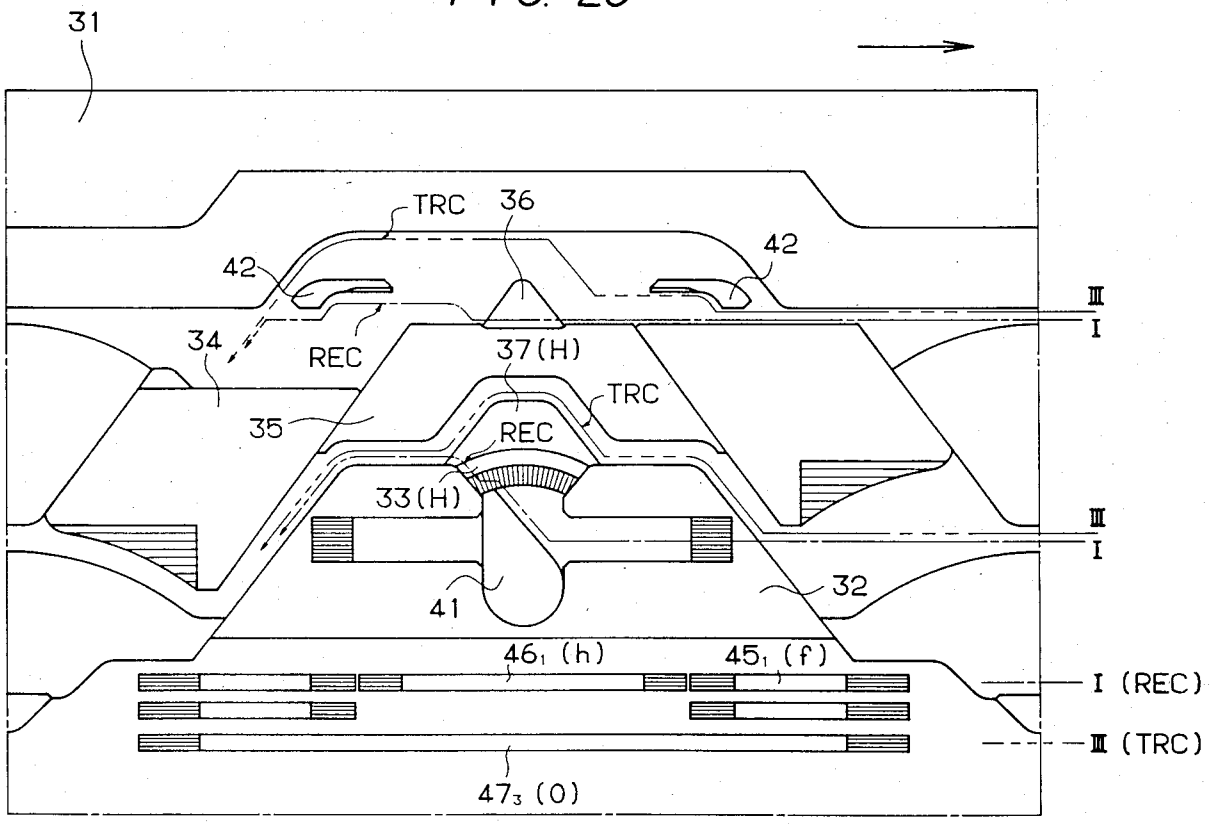
Figure 21:
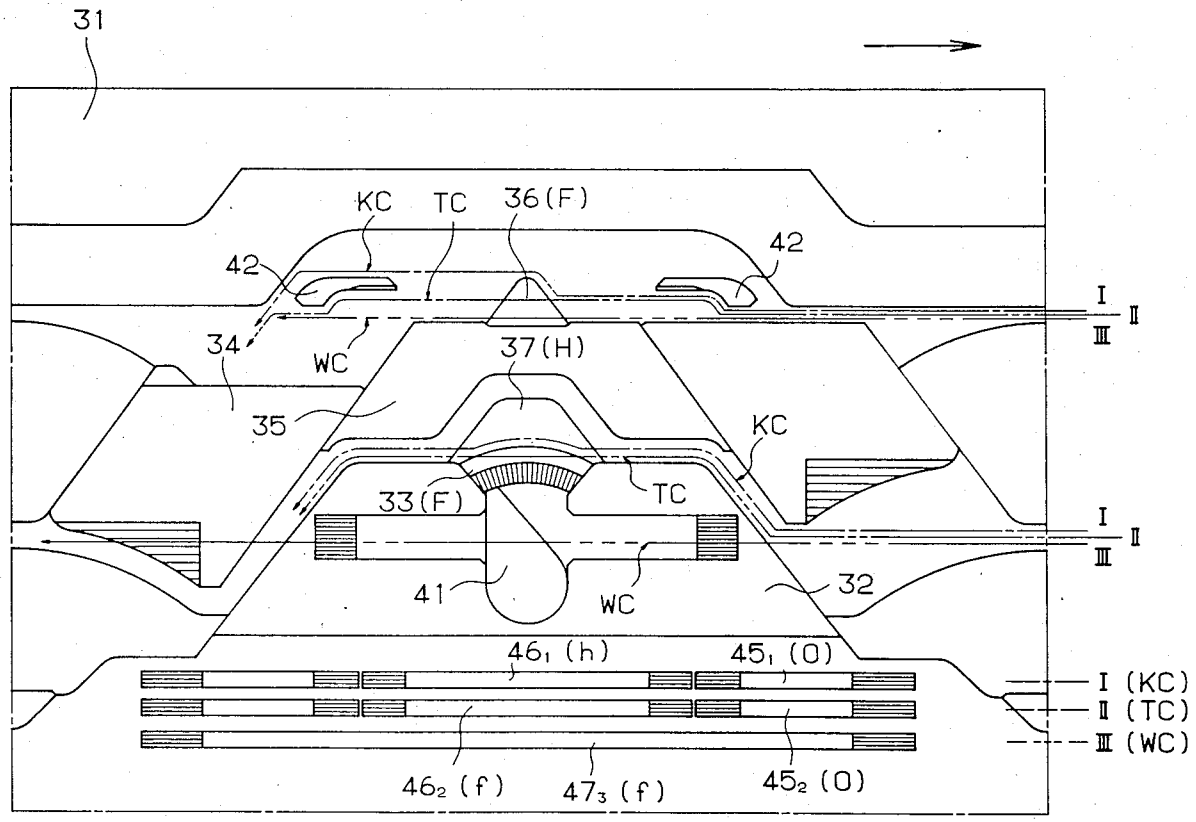
FIGS. 21 and 22 are partial views in plan of same cam plate as in FIG. 18, showing courses of movement for butts of needle bodies and for butts of sliders respectively in another embodiment.
Figure 22:
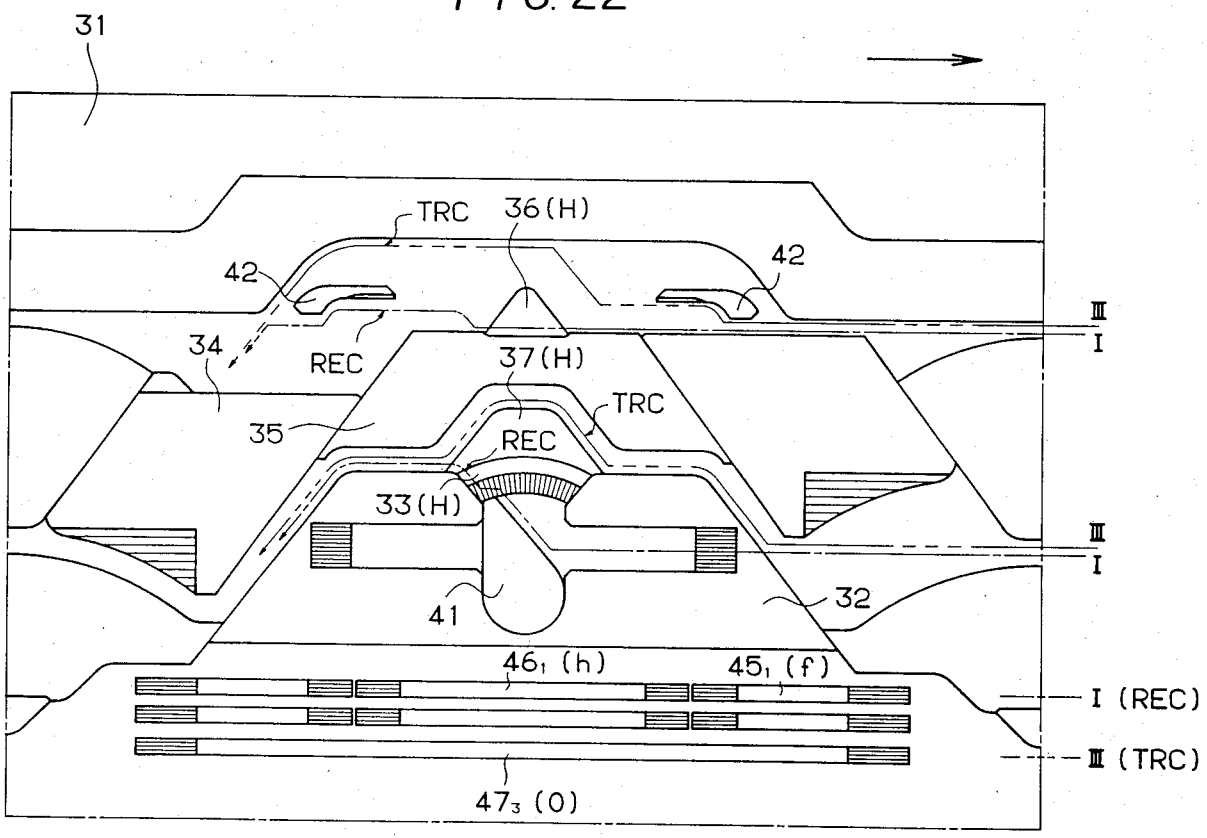

As indicated under column 1 in Control Table (2), where the height of each slider butt 11 is set at half height (H) and the height of the slider raising cam 36 at full height (F), or the height of each slider butt 11 is set at full height (F) and the height of the slider raising cam 36 at half height (H), with the height of the stitch transfer position raising cam 37 made variable between retracted position (O) and half height (H), if the height of the knit position raising cam 33 is set at half height (H) so that a proper difference in height may be provided between the tuck position raising cam 32 and the knit position raising cam 33 and between the knit position raising cam 33 and the stitch transfer position raising cam 37, it is possible to selectively guide any compound needles 1 to the knitting course (KC), the tucking course (TC), the welt course (WC), the stitch transfer course (TRC), or the stitch receiving course (REC) as is the case with the embodiments according to the first aspect of the invention (column 1 of Control Table (1)), by selecting the butts 26 of any selector jacks 22 to one of the three positions (I), (II), (III), the stitch transfer position raising cam 37 to either the half position (H) or the retracted position (O), and the side presser cams $\mathbf{45}_1$, $\mathbf{45}_2$, the center presser cam $\mathbf{46}_1$, and the side and center combination presser cam $\mathbf{47}_3$ at the three positions (I), (II), (III) individually to one of the pressing positions (f), (h) or retracted position (O) (see FIGS. 18, 19).

In the above described embodiment, the arrangement for provision of a height difference between the tuck position raising cam 32 and the knit position raising cam 33 and between the knit position raising cam 33 and the stitch transfer position raising cam 37 is that the knit position raising cam 33 are of half height (H) and the height of the stitch transfer position raising cam 37 is variable between half height (H) and retracted position (O). For the provision of such height difference, the height of the knit position raising cam 33 is variable between full height (F) and half height (H) and the stitch transfer position raising cam 37 is of half height (H) in another embodiment. By such arrangement is it possible to control any compound needles 1 in same manner as in the above described embodiment.

More specifically, in the case where the projection height of the slider butt 11 above the needle trick 20 is set at full height at which the butt 11 of the slider 5 will not be fully depressed into the needle trick 20 unless the butt 14 of the needle body is completely depressed into the needle trick 20, if the height of the slider raising cam 36 is made variable between full height (F) and half height (H), with the stitch transfer position raising cam 37 set at half height (H), it is possible to provide a height difference between the tuck position raising cam 32 and the knit position raising cam 33 and between the knit position raising cam 33 and the stitch transfer position raising cam 37 by setting the height of the knit position raising cam 33 to be variable between full height (F) and half height (H). In this case, it is possible to guide any compound needles 1 selectively to the knitting course (KC), the welt course (WC), the stitch transfer course (TRC), or the stitch receiving course (REC) by selecting the butts 26 of any selector jacks 22 to one of the three positions (I), (II), (III), the slider raising cam 36 to either full height (F) or half height (H), and the side presser cams $\mathbf{45}_1$, $\mathbf{45}_2$, the center presser cams $\mathbf{46}_1$, $\mathbf{46}_2$, and the side and center combination presser cam $\mathbf{47}_3$ at the three positions (I), (II), (III) individually to one of the pressing positions (f), (h) or retracted position (O), in same manner as is the case with the embodiments according to the first aspect of the invention (column 2 of Control Table (1)) (see FIGS. 21 and 22).

Figure 23:
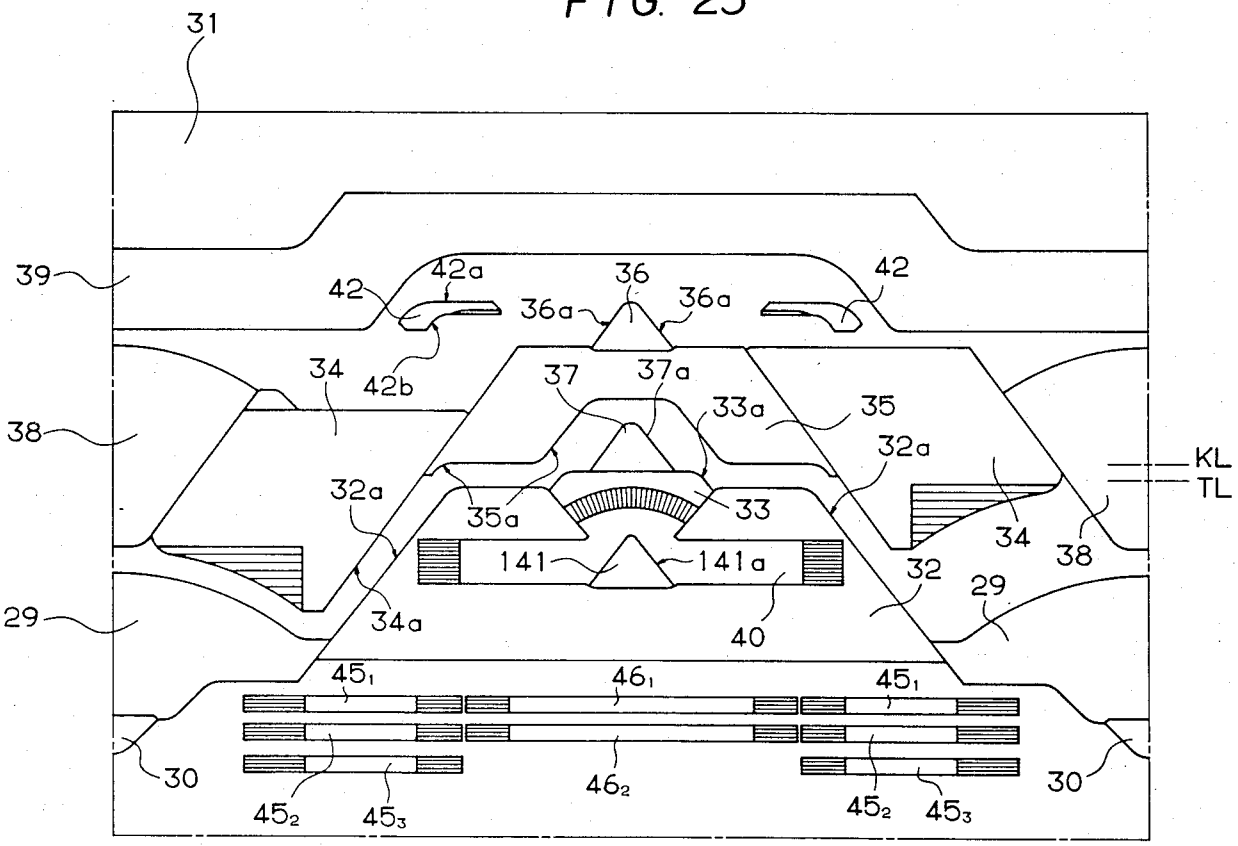
FIG. 23 is plan view showing cam plates in part in other embodiments respectively.

It is noted that in the embodiments shown in FIGS. 7 and 18, the stitch receiving course raising cam 41 disposed centrally in the space 40 is a movable cam 41 having its base 41*c* supported rotatably on the cam plate 31 for pivotal displacement over a specified angle; but in another embodiment, it may be a fixed cam (or retractable cam) 141 having a pair of raising cam faces 141*a* as shown in FIG. 23.

In the embodiment shown in FIG. 18, the raising cam faces 37*a* of the stitch transfer position raising cam 37 is such that it acts on the butt 14 of each needle body raised to the tucking position (TL), to raise the needle body 3 to the stitch transfer position (TRL). In another embodiment, as illustrated in FIG. 23, the raising cam faces 37*a* may be such that it acts on the butt 14 of each needle body, which has been raised to the knitting position (KL), to raise the needle body 3 to the stitch transfer position (TRL).

ADVANTAGES OF THE INVENTION

Constructed as above described and with its operating features explained above, the flat knitting machine in accordance with the present invention has the following advantages as may be readily understood from what has been described in detail about its functions.

In the flat knitting machine having compound needles according to the invention, any needles 1 selected individually to the three positions (I), (II), and (III) may be caused to perform in same course any three of the following five operations: knitting, tucking, welting, stitch transferring, and stitch receiving.

According to the invention, sliders may be guided separately to the upperside of and the underside of the slider guide cams by the slider raising cam which act on the butts of the sliders, whereby on each compound needle which has performed knitting, an old stitch is accurately held in position on the slider and outside the hook portion so that the old stitch may be accurately knocked over with the newly formed stitch, while on the other hand, on each compound needle which has performed tucking or which has received a stitch through transfer, an old stitch is held in a stable tuck position on the needle body whose hook portion has been opened so that the newly formed stitch or the transferred stitch is accurately placed over the old stitch.

According to the second aspect of the invention, during knitting operation, each slider may be slightly lifted, by the action of the slider raising cam, on the corresponding needle body raised through the action of the knit position raising cam to the knitting position whose level is slightly higher than the tucking position, whereby an old stitch may be mounted on the latch portion of the slider. The old stitch may be accurately knocked over by lowering the the needle body subsequently. Accordingly, it is possible to reduce the total of the stroke requirements for the slider and for the tuck position raising cam by an amount of stroke corresponding to the raising stroke of the knit position raising cam, thereby proportionally reducing the size of each compound needle and the size of the tuck position raising cam.

Further, in the flat knitting machine according to the invention, there is provided a distance corresponding to the raising stroke of the knit position raising cam between the elevated position of slider butt of each compound needle whose needle body has been raised to the tucking position by the tucking position raising cam and the elevated position of the slider butt of each compound needle whose needle body has been raised to the knitting position by the knit position raising cam, and accordingly it is possible to accurately guide individual butts at the tucking and knitting positions separately to the upperside of and the underside of the slider guide cams.

What is claimed is:

1. A flat knitting machine having compound needles of the type having a slider combined slidably with a needle body wherein the slider is back and forth movable over a given limited stroke relative to the needle body so that a latch portion of the slider is brought to a closed position and an open position with respect to a hook portion of the needle body, characterized in:

(1) that the needle body is so flexibly constructed as to allow a butt of the needle body to sink into a corresponding needle trick when the upper surface of the needle body is pressed at a point behind the butt;

(2) that both the slider and the needle body have one butt each provided thereon, the butt of the slider being located before the butt of the needle body;

(3) that a selector jack for pressing at the underside of its front portion the upper surface of the needle body at a point behind the butt thereof is disposed in the needle trick, above the needle body and behind the butt thereof, the front portion of the selector jack being pivotally movable and having an upwardly projecting butt provided thereon;

(4) that said selector jack is back and forth movable in the needle trick and adapted to be click stopped adjacent its rear end by means of a click stopper at three positions, advanced position (I), intermediate position (II), and retreated position (III), in the needle trick in the londitudinal direction thereof, being pivotally movable about the click stopper;

(5) that needle selector means for selectively moving any selector jack or jacks to any one of said three positions are arranged in individual needle tricks, at a level above the selector jacks therein, and on a carriage;

(6) that a knitting lock on the carriage includes a tuck position raising cam having a pair of raising cam faces for acting on the butt of each relevant needle body to raise the needle body to a tuck position, a pair of slider guide cams each having a lowering cam face for acting on the butt of slider of each compound needle whose needle body has been raised to the tuck position or into a stitch receiving course, to lower the slider into a tucking course, a slider raising cam having a pair of raising cam faces for acting on the butt of slider of each compound needle whose needle body has been raised to the tuck position, at a position ahead of said slider guide cam in the direction of movement of the carriage to raise the butt to a position that allows it to pass above said slider guide cam, a center guide cam for acting on the butt of the needle body to lower the needle body, and a pair of stitch cams;

(7) that a space which allows the entry thereinto of the butt of each needle body, when on a welt course, is formed between the respective back sides of said pair of raising cam faces of the tuck position raising cam, there being disposed in the middle of said space a stitch-receiving-course raising cam having a pair of raising cam faces each for acting on the butt of the needle body at welt position to raise it into the stitch receiving course, with a pair of stitch receiving courses formed above said stitch-receiving-course raising cam, said stitch receiving courses extending from the spaces on both sides of the stitch-receiving course raising cam into the tuck receiving course;

(8) that on a cam plate there is provided a stitch transfer position raising cam having a pair of raising cam faces for acting on the butt of each needle body raised to tuck position to raise the needle body to stitch transfer position;

(9) that said stitch transfer position raising cam has a half height in projection above the cam plate or is retractable;

(10) that on the cam plate and in relevant courses of action relative to the butts of individual selector jacks at advanced position (I), intermediate position (II), and retreated position (III) respectively, there are provided, at a phase covering the starting end of each raising cam face of said tuck position raising cam in the direction of carriage movement, side presser cams for selectively forcing the butts of needle bodies into the corresponding needle tricks and to their inoperative position relative to said tuck position raising cam; and at phases covering the respective raising cam faces of said stitch transfer position raising, slider raising, and stitch-receiving-course raising cams in the direction of the carriage movement, center presser cams for selectively forcing the butts of needle bodeies into the corresponding needle tricks and to their inoperative positions relative to these raising cams;

(11) that one of said center presser cams may select a half-pressing position at which the butt of each needle body is half depressed into the corresponding needle trick; and (2) that the butt of said slider is displaceable between its inoperative position and its operative position relative to the slider raising cam according to the difference in the amount of depression by said one center presser cam between a full pressing position and a half pressing position or between a half pressing position and a retracted position.

2. A flat knitting machine having compound needles as set forth in claim 1 wherein said slider guide cams each, on its slider-butt receiving side in the direction of carriage movement, has a top surface formed as a raising cam face which fronts toward the direction of carriage movement, and has on its underside a surface formed as a slope fronting toward the needle bed.

3. A flat knitting machine having compound needles as set forth in claim 1 wherein said stitch-receiving-course raising cam is a cam fixed to the cam plate.

4. A flat knitting machine having compound needles as set forth in claim 1 wherein said stitch-receiving-course raising cam is a movable cam having its base pivotally supported on the cam plate so that it is pivotally displaceable over a specified angle range.

5. A flat knitting machine having compound needles as set forth in claim 1 wherein the butt of said slider has a half height, and wherein said slider raising cam has a full height in projection above the cam plate, and wherein the height of said stitch transfer position raising cam in projection above the cam plate is variable between a retracted position and a projected position.

6. A flat knitting machine having compound needles as set forth in claim 1 wherein the butt of said slider has a full height, and wherein said slider raising cam has a half height in projection above the cam plate, and wherein the height of said stitch transfer position raising cam in projection above the cam plate is variable between a retracted position and a projected position.

7. A flat knitting machine having compound needles as set forth in claim 1 wherein the butt of said slider has a full height, and wherein the height of said slider raising cam in projection above the cam plate is variable between a full height and a half height, and wherein said stitch transfer position raising cam has a half height in projection above the cam plate.

8. A flat knitting machine having compound needles of the type having a slider combined slidably with a needle body wherein the slider is back and forth movable over a given limited stroke relative to the needle body so that a latch portion of the slider is brought to a closed position and an open position with respect to a hook portion of the needle body, characterized in:

(1) that the needle body is so flexibly constructed as to allow a butt of the needle body to sink into a corresponding needle trick when the upper surface of the needle body is pressed at a point behind the butt;

(2) that both the slider and the needle body have one butt each provided thereon, the butt of the slider being located before the butt of the needle body;

(3) that a selector jack for pressing at the underside of its front portion the upper surface of the needle body at a point behind the butt thereof is disposed in the needle trick, above the needle body and behind the butt thereof, the front portion of the selector jack being pivotally movable and having an upwardly projection butt provided thereon;

(4) that said selector jack is back and forth movable in the needle trick and adapted to be click stopped adjacent its rear end by means of a click stopper at three positions, advanced position (I), intermediate position (II), and retreated position (III), in the needle trick in the londitudinal direction thereof, being pivotally movable about the click stopper;

(5) that needle selector means for selectively moving any selector jack or jacks to any one of said three positions are arranged in individual needle tricks, at a level above the selector jacks therein, and on a carriage;

(6) that a knitting lock on the carriage includes a tuck position raising cam having a pair of raising cam faces for acting on the butt of each relevant needle body to raise the needle body to a tuck position, a pair of knit position raising cams each having a raising cam face for further raising the needle body to a knit position, a pair of slider guide cams each having a lowering cam face for acting on the butt of slider of each compound needle whose needle body has been raised to the tuck position or into a stitch receiving course, to lower the slider into a tucking course, a slider raising cam having a pair of raising cam faces for acting on the butt of slider of each compound needle whose needle body has been raised to the tuck position, at a position ahead of said slider guide cam in the direction of movement of the carriage to raise the butt to a position that allows it to pass above said slider guide cam, a center guide cam for acting on the butt of the needle body to lower the needle body, and a pair of stitch cams;

(7) that a space which allows the entry thereinto of the butt of each needle body, when on a welt course, is formed between the respective back sides of said pair of raising cam faces of the tuck position raising cam, there being disposed in the middle of said space a stitch-receiving-course raising cam having a pair of raising cam faces each for acting on the butt of the needle body at welt position to raise it into the stitch receiving course, with a pair of stitch receiving courses formed above said stitch-receiving-course raising cam, said stitch receiving courses extending from the spaces on both sides of the stitch-receiving-course raising cam into the tuck receiving course;

(8) that on a cam plate there is provided a stitch transfer position raising cam having a pair of raising cam faces for acting on the butt of each needle body raised to tuck position or knit position to raise the needle body to stitch transfer position;

(9) that said stitch transfer position raising cam has a half height in projection above the cam plate or is retractable;

(10) that said knit position raising cam has a half height in projection above the cam plate or its height above the cam plate is variable between a half height and a full height so that said tuck position raising cam may provide a greater height than the knit position raising cam, and so that the knit position raising cam may provide a greater height than the stitch transfer position raising cam;

(11) that on the cam plate and in relevant courses of action relative to the butts of individual selector jacks at advanced position (I), intermediate position (II), and retreated position (III) respectively, there are provided, at a phase covering the starting end of each raising cam face of said tuck position raising cam in the direction of carriage movement, side presser cams for selectively forcing the butts of needle bodies into the corresponding needle tricks and to their inoperative position relative to said tuck position raising cam; and at phases covering the respective raising cam faces of said knit position raising, stitch transfer position raising, slider raising, and stitch-receiving-course raising cams in the direction of the carriage movement, center presser cams for selectively forcing the butts of needle bodeies into the corresponding needle tricks and to their inoperative positions relative to these raising cams;

(12) that one of said center presser cams may select a half-pressing position at which the butt of each needle body is half depressed into the corresponding needle trick; and

(13) that the butt of said slider is displaceable between its inoperative position and its operative position relative to the slider raising cam according to the difference in the amount of depression by said one center presser cam between a full pressing position and a half pressing position or between a half pressing position and a retracted position.

9. A flat knitting machine having compound needles as set forth in claim 8 wherein said slider guide cams each, on its slider-butt receiving side in the direction of carriage movement, has a top surface formed as a raising cam face which fronts toward the direction of carriage movement, and has on its underside a surface formed as a slope fronting toward the needle bed.

10. A flat knitting machine having compound needles as set forth in claim 8 wherein said raising cam faces each of the stitch transfer position raising cam acts on the butt of each needle body raised to the tuck position to raise the needle body to the stitch transfer position.

11. A flat knitting machine having compound needles as set forth in claim 8 wherein said raising cam faces of the stitch transfer position raising cam act on the butt of each needle body raised to the knit position to raise the needle body to the stitch transfer position.

12. A flat knitting machine having compound needles as set forth in claim 8 wherein said stitch receiving course raising cam is a cam fixed to the cam plate.

13. A flat knitting machine having compound needles as set forth in claim 8 wherein said stitch receiving course raising cam is a movable cam having its base pivotally supported on the cam plate so that it is pivotally displaceable over a specified angle range.

14. A flat knitting machine having compound needles as set forth in claim 8 wherein the butt of said slider has a half height, and wherein said slider raising cam has a full height in projection above the cam plate, and wherein the height of said stitch transfer position raising cam in projection above the cam plate is variable between a retracted position and a half height, said knit position raising cam having a half height in projection above the cam plate.

15. A flat knitting machine having compound needles as set forth in claim 8 wherein the butt of said slider has a full height, and wherein said slider raising cam has a half height in projection above the cam plate, and wherein the height of said stitch transfer position raising cam in projection above the cam plate is variable between a retracted position and a projected position, said knit position raising cam having a half height in projection above the cam plate.

16. A flat knitting machine having compound needles as set forth in claim 8 wherein the butt of said slider has a full height, and wherein the height of said slider raising cam in projection above the cam plate is variable between a full height and a half height, and wherein said stitch tratransfer position raising cam has a half height in projection above the cam plate, the height of said knit position raising cam in projection above the cam plate being variable between a half height and a full height.

* * * * *